US011289034B2

(12) United States Patent
Koo et al.

(10) Patent No.: US 11,289,034 B2
(45) Date of Patent: Mar. 29, 2022

(54) DISPLAY DEVICE PERFORMING LOCAL DIMMING

(71) Applicant: Samsung Display Co., Ltd., Yongin-Si (KR)

(72) Inventors: Jahun Koo, Asan-si (KR); Seong Soon Cho, Suwon-si (KR); Jongwoon Kim, Cheonan-si (KR); Kyung-Hun Lee, Yongin-si (KR)

(73) Assignee: Samsung Display Co., Ltd.

( * ) Notice: Subject to any disclaimer, the term of this patent is extended or adjusted under 35 U.S.C. 154(b) by 61 days.

(21) Appl. No.: 16/773,887

(22) Filed: Jan. 27, 2020

(65) Prior Publication Data

US 2021/0035507 A1 Feb. 4, 2021

(30) Foreign Application Priority Data

Jul. 30, 2019 (KR) ..... KR10-2019-0092272

(51) Int. Cl.
*G09G 3/34* (2006.01)

(52) U.S. Cl.
CPC ... *G09G 3/3426* (2013.01); *G09G 2320/0233* (2013.01); *G09G 2320/0626* (2013.01)

(58) Field of Classification Search
None
See application file for complete search history.

(56) References Cited

U.S. PATENT DOCUMENTS

2009/0091265 A1* 4/2009 Song ..... G09G 3/3413 315/185 R
2010/0007682 A1* 1/2010 Kwon ..... G09G 3/3426 345/690
2011/0249033 A1* 10/2011 Oh ..... G09G 3/3426 345/690
2018/0018924 A1* 1/2018 Mao ..... G09G 3/3406

FOREIGN PATENT DOCUMENTS

KR 10-0947527 B1 3/2010

* cited by examiner

*Primary Examiner* — Kent W Chang
*Assistant Examiner* — Benjamin Morales
(74) *Attorney, Agent, or Firm* — Innovation Counsel LLP

(57) ABSTRACT

A display device includes a backlight unit including light source rows, each of the light source rows including light source blocks, a display panel configured to display an image by transmitting light emitted by the backlight unit, a panel driver configured to drive the display panel, and a backlight driver configured to drive the backlight unit. The backlight driver is configured to perform a vertical direction scan operation that sequentially select the light source rows and a horizontal direction sequential driving operation that sequentially drives the light source blocks included in a selected light source row of the light source rows.

9 Claims, 26 Drawing Sheets

FIG. 8

335

V-SCAN

LSR1

| B11 | B12 | B13 | B14 | B15 | B16 | B17 | B18 | B19 |
|---|---|---|---|---|---|---|---|---|
| 0 | 0 | 0 | 0 | 0 | 0 | 0 | 0 | 0 |
| 0 | 0 | 0 | 0 | 0 | 0 | 0 | 0 | 0 |
| 1 75 | 2.25 | 2.5 | 2.5 | 2.5 | 2.5 | 2.5 | 2.25 | 1 75 |
| 1 75 | 2.25 | 2.5 | 2.5 | 2.5 | 2.5 | 2.5 | 2.25 | 1.75 |

345

V-SCAN + H-SD

LSR1

| B11 | B12 | B13 | B14 | B15 | B16 | B17 | B18 | B19 |
|---|---|---|---|---|---|---|---|---|
| 0 | 0 | 0 | 0 | 0 | 0 | 0 | 0 | 0 |
| 0 | 0 | 0 | 0 | 0 | 0 | 0 | 0 | 0 |
| 0.25 | 0.5 | 1 | 0.5 | 0.25 | 0 | 0 | 0 | 0 |
| 0.25 | 0 75 | 1 5 | 1.5 | 0.75 | 0.25 | 0 | 0 | 0 |

FIG. 10

355

V-SCAN

LSR1

| B11 | B12 | B13 | B14 | B15 | B16 | B17 | B18 | B19 |
|---|---|---|---|---|---|---|---|---|
| 1.75 | 2.25 | 2.5 | 2.5 | 2.5 | 2.5 | 2.5 | 2.25 | 1.75 |
| 1.75 | 2.25 | 2.5 | 2.5 | 2.5 | 2.5 | 2.5 | 2.25 | 1.75 |
| 2.675 | 3.475 | 3.85 | 3.85 | 3.85 | 3.85 | 3.85 | 3.475 | 2.675 |
| 2.675 | 3.475 | 3.85 | 3.85 | 3.85 | 3.85 | 3.85 | 3.475 | 2.675 |

365

V-SCAN + H-SD

LSR1

| B11 | B12 | B13 | B14 | B15 | B16 | B17 | B18 | B19 |
|---|---|---|---|---|---|---|---|---|
| 1 | 0.5 | 0.25 | 0 | 0 | 0 | 0 | 0 | 0 |
| 1.5 | 1.5 | 0.75 | 0.25 | 0 | 0 | 0 | 0 | 0 |
| 2.25 | 2.3 | 1.875 | 0.75 | 0.25 | 0 | 0 | 0 | 0 |
| 2.3 | 3.05 | 2.175 | 1.875 | 0.75 | 0.25 | 0 | 0 | 0 |

DISPLAY DEVICE PERFORMING LOCAL DIMMING

CROSS-REFERENCE TO RELATED APPLICATION(S)

This application claims priority under 35 USC § 119 to Korean Patent Application No. 10-2019-0092272, filed on Jul. 30, 2019 in the Korean Intellectual Property Office (KIPO), the disclosure of the Korean Patent Application is incorporated herein in its entirety by reference.

BACKGROUND

1. Field

Embodiments of the present inventive concept relate to display devices, and more particularly to display devices performing local dimming.

2. Description of the Related Art

In a display device, such as a liquid crystal display (LCD) device, luminance of the display device is determined by a product of luminance of a backlight unit and light transmittance of liquid crystals depending on image data. The LCD device may employ a backlight dimming method for the purpose of increasing a contrast ratio and reducing power consumption. The backlight dimming method controls backlight luminance and compensates image data by analyzing an input image and adjusting a dimming value based on the analysis. For example, to reduce power consumption, the backlight dimming method may reduce the backlight luminance by decreasing a dimming value (or a duty), and may increase the luminance through data compensation. Thus, power consumption of the backlight unit may be reduced.

A light emitting diode (LED) backlight unit using LEDs as a light source has been used for the backlight unit. The LEDs may boast of high luminance and low power consumption, compared with conventional lamps. Because the LEDs of the LED backlight unit allow for location-based control, the LEDs may be driven by local dimming According to the local dimming technology, the LED backlight unit may be divided into light source blocks and luminance may be controlled on a block-by-block basis. Further, in the local dimming method, local dimming values (or duties) may be determined by analyzing image data on a block basis, and the image data may be compensated based on the local dimming values. Accordingly, the contrast ratio may be increased, and the power consumption may be decreased.

In a conventional display device, to reduce after images or motion blurring, light source rows of the backlight unit are sequentially driven on a row-by-row basis when the local dimming is performed. However, a waterfall phenomenon where a horizontal line image having relatively high or low luminance exists or gradually moves may be caused by the sequential driving of the light source rows.

SUMMARY

Some example embodiments provide a display device capable of preventing or reducing a waterfall phenomenon when local dimming is performed.

According to example embodiments, there is provided a display device including a backlight unit including a plurality of light source rows, each of the plurality of light source rows including a plurality of light source blocks, a display panel configured to display an image by transmitting light emitted by the backlight unit, a panel driver configured to drive the display panel, and a backlight driver configured to drive the backlight unit. The backlight driver performs a vertical direction scan operation that sequentially selects the plurality of light source rows and a horizontal direction sequential driving operation that sequentially drives the plurality of light source blocks included in a selected one of the plurality of light source rows.

In example embodiments, to perform the vertical direction scan operation, the backlight driver may sequentially select one of the plurality of light source rows per first time.

In example embodiments, the first time may be determined by dividing a frame time by a number of the plurality of light source rows.

In example embodiments, to perform the horizontal direction sequential driving operation, the backlight driver may sequentially drive one of the plurality of light source blocks included in the selected one of the plurality of light source rows per second time.

In example embodiments, the second time may be determined by dividing a latency time from a data input time point to an image display time point by a number of the plurality of light source blocks included in each of the plurality of light source rows.

In example embodiments, the plurality of light source rows may include a first light source row and a second light source row, and the backlight driver may initiate the horizontal direction sequential driving operation for the second light source row before the horizontal direction sequential driving operation for the first light source row is completed.

In example embodiments, each of the plurality of light source rows may include first through M-th light source blocks, where M is an integer greater than 1. To perform the horizontal direction sequential driving operation, the backlight driver may sequentially drive the first through M-th light source blocks included in the selected one of the plurality of light source rows in a first horizontal direction from the first light source block to the M-th light source block in an odd-numbered frame, and may sequentially drive the first through M-th light source blocks included in the selected one of the plurality of light source rows in a second horizontal direction from the M-th light source block to the first light source block in an even-numbered frame.

According to example embodiments, there is provided a display device including a backlight unit including a plurality of light source rows, each of the plurality of light source rows including a plurality of light source blocks, a display panel configured to display an image by transmitting light emitted by the backlight unit, a panel driver configured to drive the display panel, and a backlight driver configured to drive the backlight unit. The backlight driver divides the backlight unit into a plurality of horizontal regions, and performs, in each of the plurality of horizontal regions, a vertical direction scan operation that sequentially selects the plurality of light source rows and a horizontal direction sequential driving operation that sequentially drives the plurality of light source blocks included in a selected one of the plurality of light source rows.

In example embodiments, to perform the horizontal direction sequential driving operation in each of the plurality of horizontal regions, the backlight driver may sequentially drive one of the plurality of light source blocks included in the selected one of the plurality of light source rows in each of the plurality of horizontal regions per a block shift time.

In example embodiments, the block shift time may be determined by dividing a latency time from a data input time point to an image display time point by a number of the plurality of light source blocks included in each of the plurality of light source rows in each of the plurality of horizontal regions.

In example embodiments, to perform the horizontal direction sequential driving operation in each of the plurality of horizontal regions, the backlight driver may sequentially drive the plurality of light source blocks in the selected one of the plurality of light source rows in each of the plurality of horizontal regions in a first horizontal direction in an odd-numbered frame, and may sequentially drive the plurality of light source blocks in the selected one of the plurality of light source rows in each of the plurality of horizontal regions in a second horizontal direction opposite to the first horizontal direction in an even-numbered frame.

In example embodiments, the backlight driver may group the plurality of light source rows into an odd-numbered light source row group and an even-numbered light source row group. To perform the horizontal direction sequential driving operation in each of the plurality of horizontal regions, the backlight driver may sequentially drive the plurality of light source blocks in the selected one of the plurality of light source rows belonging to the odd-numbered light source row group in each of the plurality of horizontal regions in a first horizontal direction, and may sequentially drive the plurality of light source blocks in the selected one of the plurality of light source rows belonging to the even-numbered light source row group in each of the plurality of horizontal regions in a second horizontal direction opposite to the first horizontal direction.

In example embodiments, the backlight driver may group the plurality of light source rows into an odd-numbered light source row group and an even-numbered light source row group. To perform the horizontal direction sequential driving operation in each of the plurality of horizontal regions in an odd-numbered frame, the backlight driver may sequentially drive the plurality of light source blocks in the selected one of the plurality of light source rows belonging to the odd-numbered light source row group in each of the plurality of horizontal regions in a first horizontal direction, and may sequentially drive the plurality of light source blocks in the selected one of the plurality of light source rows belonging to the even-numbered light source row group in each of the plurality of horizontal regions in a second horizontal direction opposite to the first horizontal direction. To perform the horizontal direction sequential driving operation in each of the plurality of horizontal regions in an even-numbered frame, the backlight driver may sequentially drive the plurality of light source blocks in the selected one of the plurality of light source rows belonging to the odd-numbered light source row group in each of the plurality of horizontal regions in the second horizontal direction, and may sequentially drive the plurality of light source blocks in the selected one of the plurality of light source rows belonging to the even-numbered light source row group in each of the plurality of horizontal regions in the first horizontal direction.

In example embodiments, the backlight driver may group (4K+1)-th and (4K+2)-th ones of the plurality of light source rows into a first light source row group, and may group (4K+3)-th and (4K+4)-th ones of the plurality of light source rows into a second light source row group, where K is an integer greater than 0. To perform the horizontal direction sequential driving operation in each of the plurality of horizontal regions, the backlight driver may sequentially drive the plurality of light source blocks in the selected one of the plurality of light source rows belonging to the first light source row group in each of the plurality of horizontal regions in a first horizontal direction, and may sequentially drive the plurality of light source blocks in the selected one of the plurality of light source rows belonging to the second light source row group in each of the plurality of horizontal regions in a second horizontal direction opposite to the first horizontal direction.

In example embodiments, the backlight driver may group (4K+1)-th and (4K+2)-th ones of the plurality of light source rows into a first light source row group, and may group (4K+3)-th and (4K+4)-th ones of the plurality of light source rows into a second light source row group, where K is an integer greater than 0. To perform the horizontal direction sequential driving operation in each of the plurality of horizontal regions in an odd-numbered frame, the backlight driver may sequentially drive the plurality of light source blocks in the selected one of the plurality of light source rows belonging to the first light source row group in each of the plurality of horizontal regions in a first horizontal direction, and may sequentially drive the plurality of light source blocks in the selected one of the plurality of light source rows belonging to the second light source row group in each of the plurality of horizontal regions in a second horizontal direction opposite to the first horizontal direction. To perform the horizontal direction sequential driving operation in each of the plurality of horizontal regions in an even-numbered frame, the backlight driver may sequentially drive the plurality of light source blocks in the selected one of the plurality of light source rows belonging to the first light source row group in each of the plurality of horizontal regions in the second horizontal direction, and may sequentially drive the plurality of light source blocks in the selected one of the plurality of light source rows belonging to the second light source row group in each of the plurality of horizontal regions in the first horizontal direction.

In example embodiments, to perform the horizontal direction sequential driving operation in an odd-numbered horizontal region of the plurality of horizontal regions, the backlight driver may sequentially drive the plurality of light source blocks in the selected one of the plurality of light source rows in the odd-numbered horizontal region in a first horizontal direction. To perform the horizontal direction sequential driving operation in an even-numbered horizontal region of the plurality of horizontal regions, the backlight driver may sequentially drive the plurality of light source blocks in the selected one of the plurality of light source rows in the even-numbered horizontal region in a second horizontal direction opposite to the first horizontal direction.

In example embodiments, the horizontal direction sequential driving operation in the odd-numbered horizontal region and the horizontal direction sequential driving operation in the even-numbered horizontal region may have different start time points.

In example embodiments, the horizontal direction sequential driving operation in the odd-numbered horizontal region and the horizontal direction sequential driving operation in the even-numbered horizontal region may have different block shift times.

In example embodiments, to perform the horizontal direction sequential driving operation in an odd-numbered horizontal region of the plurality of horizontal regions, the backlight driver may sequentially drive the plurality of light source blocks in the selected one of the plurality of light source rows in the odd-numbered horizontal region in a first horizontal direction in an odd-numbered frame, and may sequentially drive the plurality of light source blocks in the selected one of the plurality of light source rows in the odd-numbered horizontal region in a second horizontal direction opposite to the first horizontal direction in an even-numbered frame. To perform the horizontal direction sequential driving operation in an even-numbered horizontal region of the plurality of horizontal regions, the backlight driver may sequentially drive the plurality of light source blocks in the selected one of the plurality of light source rows in the even-numbered horizontal region in the second horizontal direction in the odd-numbered frame, and may sequentially drive the plurality of light source blocks in the selected one of the plurality of light source rows in the even-numbered horizontal region in the first horizontal direction in the even-numbered frame.

In example embodiments, the horizontal direction sequential driving operation in the odd-numbered horizontal region and the horizontal direction sequential driving operation in the even-numbered horizontal region may have different start time points or different block shift times.

An embodiment may be related to a display device. The display device includes a backlight unit including light source rows, each of the light source rows including light source blocks; a display panel configured to display an image by transmitting light emitted by the backlight unit; a panel driver configured to drive the display panel; and a backlight driver configured to drive the backlight unit. The backlight driver is configured to perform a vertical direction scan operation that sequentially selects the light source rows and a horizontal direction sequential driving operation that sequentially drives the light source blocks included in a selected light source row of the light source rows.

To perform the vertical direction scan operation, the backlight driver is configured to sequentially select a light source row of the light source rows based on a first time period.

The first time period is determined by dividing a frame time by a number of the light source rows.

To perform the horizontal direction sequential driving operation, the backlight driver is configured to sequentially drive a light source block of the light source blocks included in the selected light source row of the light source rows based on a second time period.

The second time period is determined by dividing a latency time from a data input time point to an image display time point by a number of the light source blocks included in each of the light source rows.

The light source rows include a first light source row and a second light source row, and the backlight driver is configured to initiate the horizontal direction sequential driving operation for the second light source row before the horizontal direction sequential driving operation for the first light source row is completed.

Each of the light source rows includes first through M-th light source blocks, where M is an integer greater than 1. To perform the horizontal direction sequential driving operation, the backlight driver is configured to sequentially drive the first through M-th light source blocks included in the selected light source row of the light source rows in a first horizontal direction from the first light source block to the M-th light source block in an odd-numbered frame, and sequentially drive the first through M-th light source blocks included in the selected light source row of the light source rows in a second horizontal direction from the M-th light source block to the first light source block in an even-numbered frame.

In an embodiment, the display device includes a backlight unit including light source rows, each of the light source rows including light source blocks; a display panel configured to display an image by transmitting light emitted by the backlight unit; a panel driver configured to drive the display panel; and a backlight driver configured to drive the backlight unit. The backlight driver is configured to divide the backlight unit into horizontal regions, and perform, in each of the horizontal regions, a vertical direction scan operation that sequentially selects the light source rows and a horizontal direction sequential driving operation that sequentially drives the light source blocks included in a selected light source row of the light source rows.

To perform the horizontal direction sequential driving operation in each of the horizontal regions, the backlight driver is configured to sequentially drive a light source block of the light source blocks included in the selected light source row of the light source rows in each of the horizontal regions per a block shift time.

The block shift time is determined by dividing a latency time from a data input time point to an image display time point by a number of the light source blocks included in each of the light source rows in each of the horizontal regions.

To perform the horizontal direction sequential driving operation in each of the horizontal regions, the backlight driver is configured to sequentially drive the light source blocks in the selected light source row of the light source rows in each of the horizontal regions in a first horizontal direction in an odd-numbered frame, and sequentially drive the light source blocks in the selected light source row of the light source rows in each of the horizontal regions in a second horizontal direction opposite to the first horizontal direction in an even-numbered frame.

The backlight driver is configured to group the light source rows into an odd-numbered light source row group and an even-numbered light source row group. To perform the horizontal direction sequential driving operation in each of the horizontal regions, the backlight driver is configured to sequentially drive the light source blocks in the selected light source row of the light source rows belonging to the odd-numbered light source row group in each of the horizontal regions in a first horizontal direction, and sequentially drive the light source blocks in the selected light source row of the light source rows belonging to the even-numbered light source row group in each of the horizontal regions in a second horizontal direction opposite to the first horizontal direction.

The backlight driver is configured to group the light source rows into an odd-numbered light source row group and an even-numbered light source row group. To perform the horizontal direction sequential driving operation in each of the horizontal regions in an odd-numbered frame, the backlight driver is configured to sequentially drive the light source blocks in the selected light source row of the light source rows belonging to the odd-numbered light source row group in each of the horizontal regions in a first horizontal direction, and sequentially drive the light source blocks in the selected light source row of the light source rows belonging to the even-numbered light source row group in each of the horizontal regions in a second horizontal direction opposite to the first horizontal direction. To perform the horizontal direction sequential driving operation in each of the horizontal regions in an even-numbered frame, the backlight driver is configured to sequentially drive the light source blocks in the selected light source row of the light source rows belonging to the odd-numbered light source row group in each of the horizontal regions in the second horizontal direction, and sequentially drive the light source blocks in the selected light source row of the light source rows belonging to the even-numbered light source row group in each of the horizontal regions in the first horizontal direction.

The backlight driver is configured to group (4K+1)-th and (4K+2)-th light source rows of the light source rows into a first light source row group, and group (4K+3)-th and (4K+4)-th light source rows of the light source rows into a second light source row group, where K is an integer greater than 0. To perform the horizontal direction sequential driving operation in each of the horizontal regions, the backlight driver is configured to sequentially drive the light source blocks in the selected light source row of the light source rows belonging to the first light source row group in each of the horizontal regions in a first horizontal direction, and sequentially drive the light source blocks in the selected light source row of the light source rows belonging to the second light source row group in each of the horizontal regions in a second horizontal direction opposite to the first horizontal direction.

The backlight driver is configured to group (4K+1)-th and (4K+2)-th light source rows of the light source rows into a first light source row group, and group (4K+3)-th and (4K+4)-th light source rows of the light source rows into a second light source row group, where K is an integer greater than 0. To perform the horizontal direction sequential driving operation in each of the horizontal regions in an odd-numbered frame, the backlight driver is configured to sequentially drive the light source blocks in the selected light source row of the light source rows belonging to the first light source row group in each of the horizontal regions in a first horizontal direction, and sequentially drive the light source blocks in the selected light source row of the light source rows belonging to the second light source row group in each of the horizontal regions in a second horizontal direction opposite to the first horizontal direction. To perform the horizontal direction sequential driving operation in each of the horizontal regions in an even-numbered frame, the backlight driver is configured to sequentially drive the light source blocks in the selected light source row of the light source rows belonging to the first light source row group in each of the horizontal regions in the second horizontal direction, and sequentially drive the light source blocks in the selected light source row of the light source rows belonging to the second light source row group in each of the horizontal regions in the first horizontal direction.

To perform the horizontal direction sequential driving operation in an odd-numbered horizontal region of the horizontal regions, the backlight driver is configured to sequentially drive the light source blocks in the selected light source row of the light source rows in the odd-numbered horizontal region in a first horizontal direction. To perform the horizontal direction sequential driving operation in an even-numbered horizontal region of the horizontal regions, the backlight driver is configured to sequentially drive the light source blocks in the selected light source row of the light source rows in the even-numbered horizontal region in a second horizontal direction opposite to the first horizontal direction.

The horizontal direction sequential driving operation in the odd-numbered horizontal region and the horizontal direction sequential driving operation in the even-numbered horizontal region have different start time points.

The horizontal direction sequential driving operation in the odd-numbered horizontal region and the horizontal direction sequential driving operation in the even-numbered horizontal region have different block shift times.

To perform the horizontal direction sequential driving operation in an odd-numbered horizontal region of the horizontal regions, the backlight driver is configured to sequentially drive the light source blocks in the selected light source row of the light source rows in the odd-numbered horizontal region in a first horizontal direction in an odd-numbered frame, and sequentially drive the light source blocks in the selected light source row of the light source rows in the odd-numbered horizontal region in a second horizontal direction opposite to the first horizontal direction in an even-numbered frame. To perform the horizontal direction sequential driving operation in an even-numbered horizontal region of the horizontal regions, the backlight driver is configured to sequentially drive the light source blocks in the selected light source row of the light source rows in the even-numbered horizontal region in the second horizontal direction in the odd-numbered frame, and sequentially drive the light source blocks in the selected light source row of the light source rows in the even-numbered horizontal region in the first horizontal direction in the even-numbered frame.

The horizontal direction sequential driving operation in the odd-numbered horizontal region and the horizontal direction sequential driving operation in the even-numbered horizontal region have different start time points or different block shift times.

As described above, a display device according to example embodiments may perform a vertical direction scan operation that sequentially selects light source rows included in a backlight unit, and a horizontal direction sequential driving operation that sequentially drives light source blocks included in a selected one of the light source rows. Accordingly, while local dimming is performed, a waterfall phenomenon where a relatively high or low luminance horizontal line image exists or gradually moves may be prevented or reduced.

BRIEF DESCRIPTION OF THE DRAWINGS

Illustrative, non-limiting example embodiments will be more clearly understood from the following detailed description in conjunction with the accompanying drawings.

FIG. 8 is a diagram of luminance influences by adjacent light source blocks of first light source rows according to driving timings of FIG. 7 according to an example embodiment.

FIG. 10 is a diagram of luminance influences by adjacent light source blocks of first light source rows according to driving timings of FIG. 9 according to an example embodiment.

DETAILED DESCRIPTION OF THE EMBODIMENTS

Hereinafter, embodiments of the present inventive concept will be explained in detail with reference to the accompanying drawings.

Figure 1:
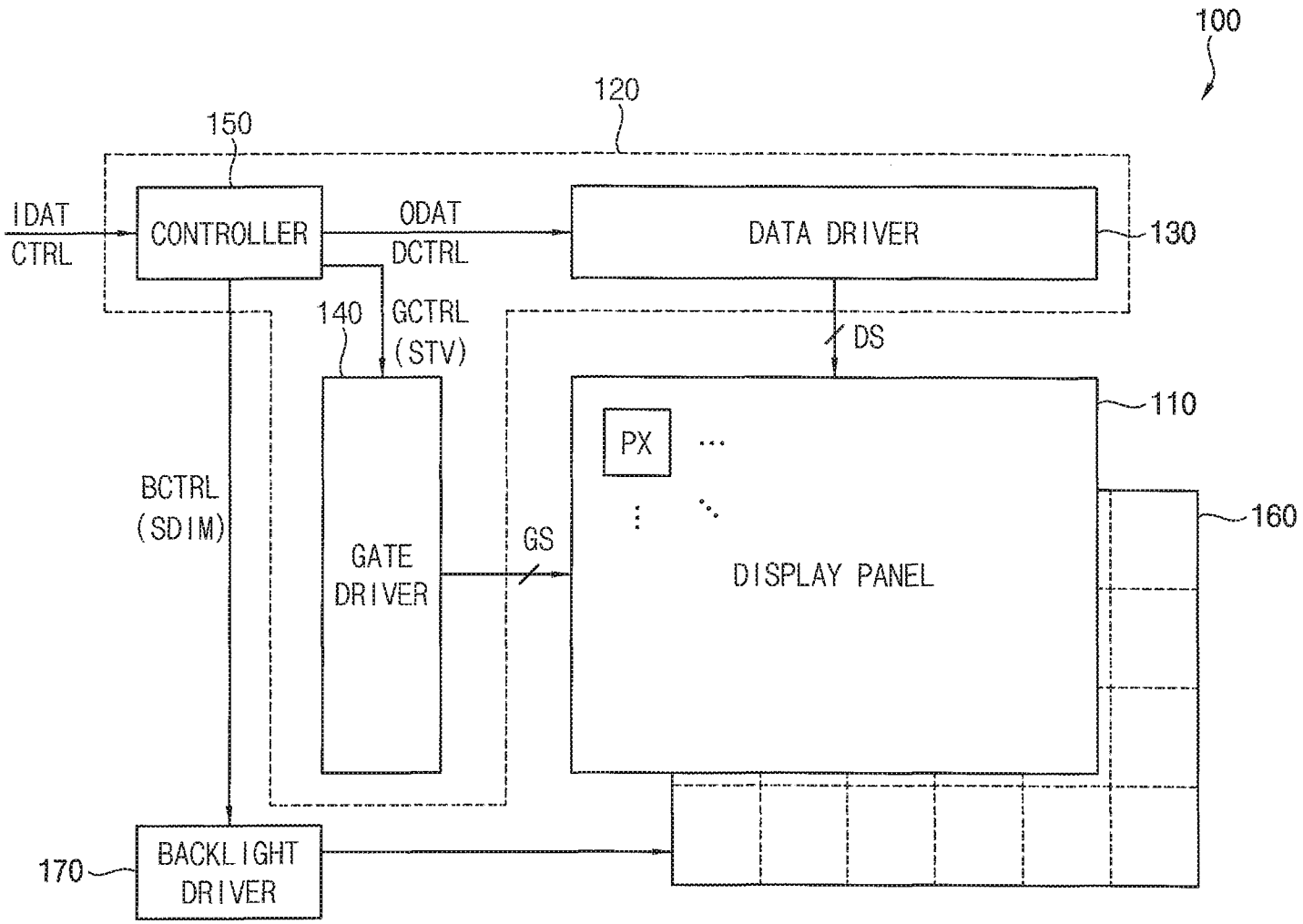
FIG. 1 is a block diagram of a display device according to an example embodiment.
Figure 2:
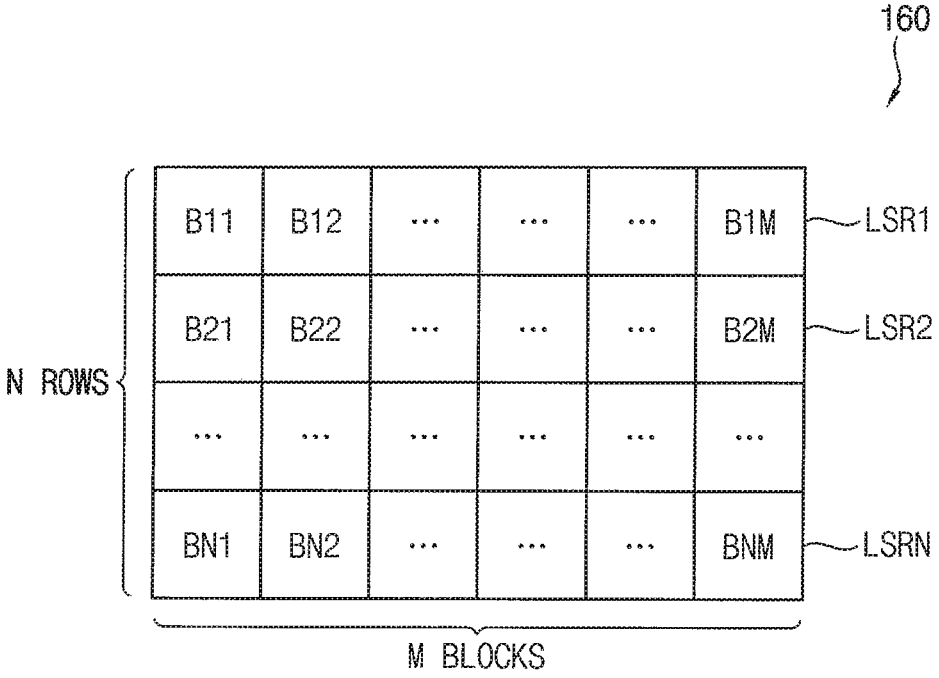
FIG. 2 is a diagram of a backlight unit included in a display device according to an example embodiment.

FIG. 1 is a block diagram illustrating a display device 100 according to an example embodiment. FIG. 2 is a diagram of a backlight unit 160 included in a display device according to an example embodiment.

Referring to FIG. 1, the display device 100 may include a display panel 110, a panel driver 120 that drives the display panel 110, the backlight unit 160, and a backlight driver 170 that drives the backlight unit 160. In an example embodiment, the panel driver 120 may include a data driver 130 that provides data signals DS to the display panel 110, a gate driver 140 that provides gate signals GS to the display panel 110, and a controller 150 that controls an operation of the display device 100.

The display panel 110 may include data lines, gate lines, and pixels PX coupled to the data lines and the gate lines. The display panel 110 may selectively transmit light emitted by the backlight unit 160 to display an image. In some example embodiments, each pixel PX may include a switching transistor and a liquid crystal capacitor coupled to the switching transistor, and the display panel 110 may be a liquid crystal display (LCD) panel. However, the display panel 110 according to example embodiments may be any suitable display panel. The display panel 110 may include pixel blocks respectively corresponding to light source blocks of the backlight unit 160. Here, a set of the pixels PX located corresponding to one light source block may be referred to as the pixel block. Thus, here, the pixel block may be a logical unit of the pixels PX that are grouped according to the light source block, and the pixel blocks may not be physically or structurally distinguished from each other.

The data driver 130 may generate the data signals DS based on output image data ODAT and a data control signal DCTRL received from the controller 150, and may provide the data signals DS to the pixels PX through the data lines. For example, the data control signal DCTRL may include an output data enable signal, a horizontal start signal and a load signal. In an example embodiment, the data driver 130 may be implemented with one or more data integrated circuits (ICs). Further, according to an example embodiment, the data driver 130 may be mounted directly on the display panel 110 in a form of a chip on glass (COG), or may be coupled to the display panel 110 in a form of a chip on film (COF) or a tape carrier package (TCP). In an example embodiment, the data driver 130 may be integrated in a peripheral portion of the display panel 110.

The gate driver 140 may generate the gate signals GS based on a gate control signal GCTRL received from the controller 150, and may provide the gate signals GS to the pixels PX through the gate lines. For example, the gate control signal GCTRL may include a vertical start signal STV and a gate clock signal. In some example embodiments, the gate driver 140 may be implemented as an amorphous silicon gate (ASG) driver integrated in the peripheral portion of the display panel 110. In other example embodiments, the gate driver 140 may be implemented with one or more gate ICs. Further, according to some example embodiments, the gate driver 140 may be mounted directly on the display panel 110 in the form of COG, or may be coupled to the display panel 110 in the form of COF or TCP.

The controller 150, e.g., a timing controller, may receive input image data IDAT and a control signal CTRL from an external host, e.g., a graphic processing unit (GPU) or a graphic card. For example, the input image data IDAT may be RGB image data including red image data, green image data and blue image data. Further, for example, the control signal CTRL may include a master clock signal, a data enable signal, a vertical synchronization signal, a horizontal synchronization signal, etc. The controller 150 may generate the output image data ODAT, the data control signal DCTRL, the gate control signal GCTRL and a backlight control signal BCTRL based on the input image data IDAT and the control signal CTRL. In some example embodiments, the controller 150 may generate the output image data ODAT by performing an image enhancement operation, a luminance non-uniformity correction operation, a dynamic capacitance compensation (DCC) operation, etc. on the input image data IDAT. The controller 150 may control an operation of the data driver 130 by providing the output image data ODAT and the data control signal DCTRL to the data driver 130, may control an operation of the gate driver 140 by providing the gate control signal GCTRL to the gate driver 140, and may control an operation of the backlight driver 170 by providing the backlight control signal BCTRL to the backlight driver 170.

The backlight unit 160 may include light source rows, and each light source row may include light source blocks. For example, as illustrated in FIG. 2, the backlight unit 160 may include N light source rows, or first through N-th light source rows LSR1, LSR2, . . . , LSRN, where N is an integer greater than 1. Further, each of the first through N-th light source rows LSR1, LSR2, . . . , LSRN may include M light source blocks, or first through M-th light source blocks B11, B12, . . . , B1M, B21, B22, . . . , B2M, . . . , BN1, BN2, . . . , BNM, where M is an integer greater than 1. Thus, the backlight unit 160 may include N*M light source blocks B11, B12, . . . , B1M, B21, B22, . . . , B2M, . . . , BN1, BN2, . . . , BNM. The N*M light source blocks B11, B12, . . . , B1M, B21, B22, . . . , B2M, . . . , BN1, BN2, . . . , BNM may be driven independently of each other. In some example embodiments, the backlight unit 160 may be a direct-type light emitting diode (LED) backlight using LEDs as a light source.

The backlight driver 170 may drive the backlight unit 160 based on the backlight control signal BCTRL received from the controller 150. In an example embodiment, the backlight control signal BCTRL may include a dimming signal SDIM representing that local dimming is to be performed, and the backlight driver 170 may perform the local dimming in response to the dimming signal SDIM. In some example embodiments, the dimming signal SDIM may further represent duties of light source block driving signals, e.g., pulse width modulation (PWM) signals, that are to be respectively applied to the N*M light source blocks B11, B12, . . . , B1M, B21, B22, . . . , B2M, . . . , BN1, BN2, . . . , BNM included in the backlight unit 160. For example, the controller 150 may determine the duties of the light source block driving signals by analyzing the input image data IDAT for the pixel blocks of the display panel 110 respectively corresponding to the N*M light source blocks B11, B12, . . . , B1M, B21, B22, . . . , B2M, . . . , BN1, BN2, . . . , BNM, and may provide the dimming signal SDIM representing the determined duties to the backlight driver 170. In an example, the controller 150 may determine the duty of the light source block driving signal for each light source block according to a representative gray value (e.g., a maximum gray value and/or an average gray value) of the pixel block corresponding to each light source block. The backlight driver 170 may perform the local dimming by driving the N*M light source blocks B11, B12, . . . , B1M, B21, B22, . . . , B2M, . . . , BN1, BN2, . . . , BNM with the determined duties represented by the dimming signal SDIM, or by driving the N*M light source blocks B11, B12, . . . , B1M, B21, B22, . . . , B2M, . . . , BN1, BN2, . . . , BNM for durations corresponding to the determined duties.

To perform the local dimming, the backlight driver 170 may sequentially drive the N*M light source blocks B11, B12, . . . , B1M, B21, B22, . . . , B2M, . . . , BN1, BN2, . . . , BNM not only in a vertical direction, e.g., in a direction of each data line, but also in a horizontal direction, e.g., in a direction of each gate line. Thus, driving start time points of the N*M light source blocks B11, B12, . . . , B1M, B21, B22, . . . , B2M, . . . , BN1, BN2, . . . , BNM may be determined sequentially in the vertical direction and the horizontal direction, and driving durations, i.e., the time period or length of time of driving, of the N*M light source blocks B11, B12, . . . , B1M, B21, B22, . . . , B2M, . . . , BN1, BN2, . . . , BNM may be determined by the determined duties represented by the dimming signal SDIM. In an example embodiment, to sequentially drive the N*M light source blocks B11, B12, . . . , B1M, B21, B22, . . . , B2M, . . . , BN1, BN2, . . . , BNM in the vertical direction and in the horizontal direction, the backlight driver 170 performs a vertical direction scan operation that sequentially select the light source rows LSR1, LSR2, . . . , LSRN and a horizontal direction sequential driving operation that sequentially drives the light source blocks, e.g., B11, B12, . . . , B1M, included in each selected light source row, e.g., light source row LSR1.

In a conventional display device, light source rows of a backlight unit may be sequentially driven to perform the local dimming, and light source blocks in each light source row may be substantially simultaneously driven. Since the light source blocks in each light source row are substantially simultaneously driven, luminance of each light source block may be affected by luminances of adjacent light source blocks. In particular, when the local dimming is performed in the conventional display device, a waterfall phenomenon where a relatively high or low luminance horizontal line image exists or gradually moves may be caused by the sequential driving of the light source rows. However, in the display device 100 according to an example embodiment, the light source blocks B11, B12, . . . , B1M, B21, B22, . . . , B2M, . . . , BN1, BN2, . . . , BNM of the backlight unit 160 are sequentially driven in the vertical direction and the horizontal direction by the vertical direction scan operation and the horizontal direction sequential driving operation. Accordingly, the influence of the luminance of the adjacent light source blocks on the luminance of each light source block may be reduced, and the waterfall phenomenon may be prevented or reduced while the local dimming is performed.

Figure 3:
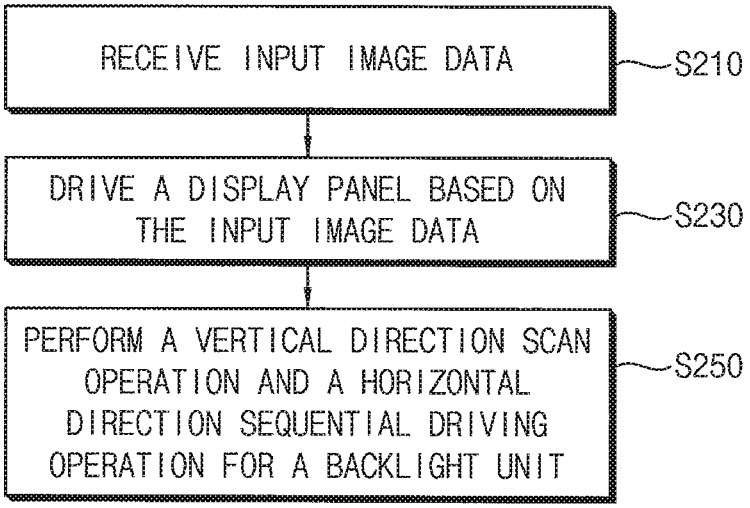
FIG. 3 is a flowchart of an operation of a display device according to an example embodiment.
Figure 4:
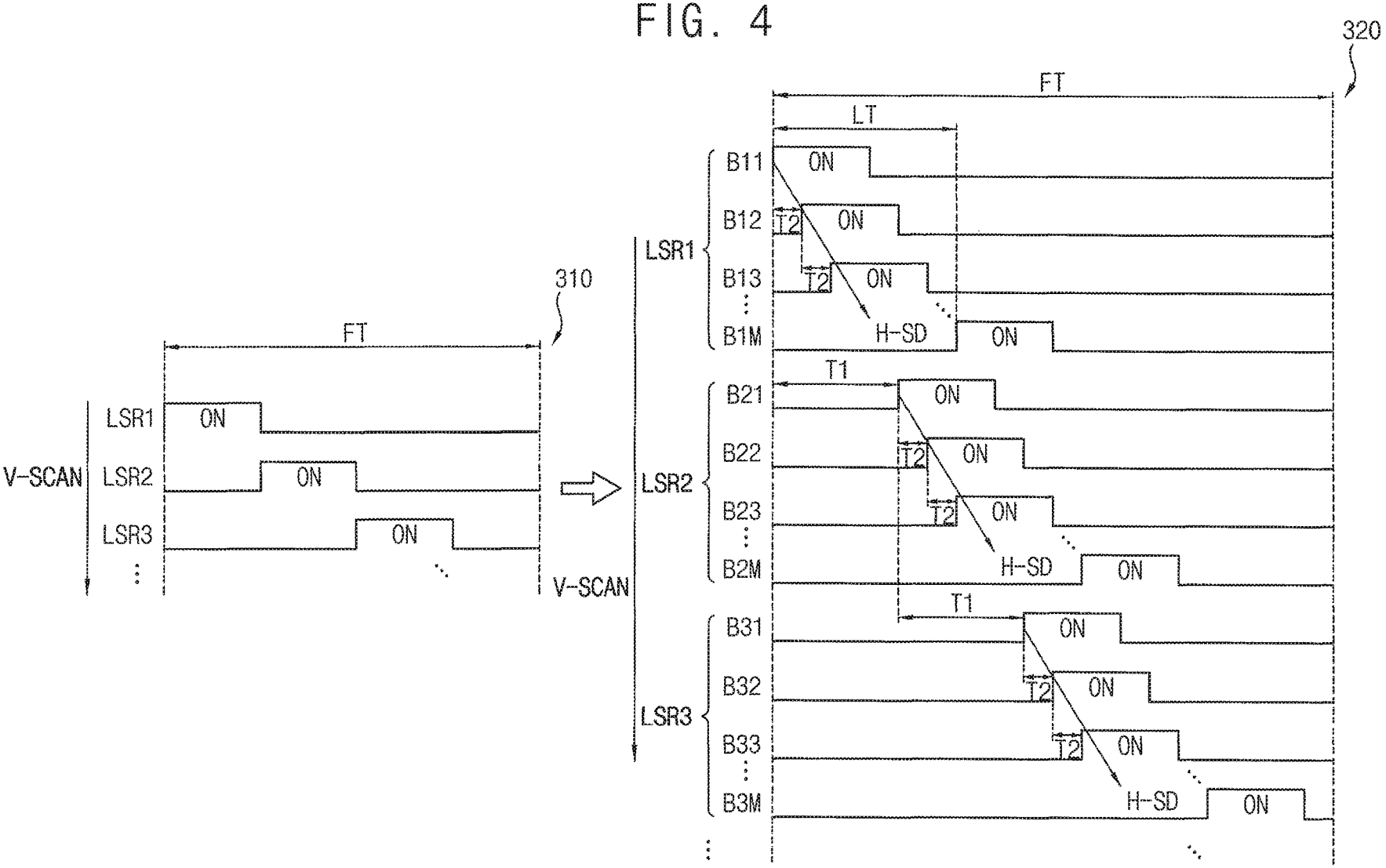
FIG. 4 is a diagram illustrating a driving timing of a backlight unit of a display device performing only a vertical direction scan operation and a driving timing of a backlight unit of a display device performing both of a vertical direction scan operation and a horizontal direction sequential driving operation according to an example embodiment.
Figure 5:
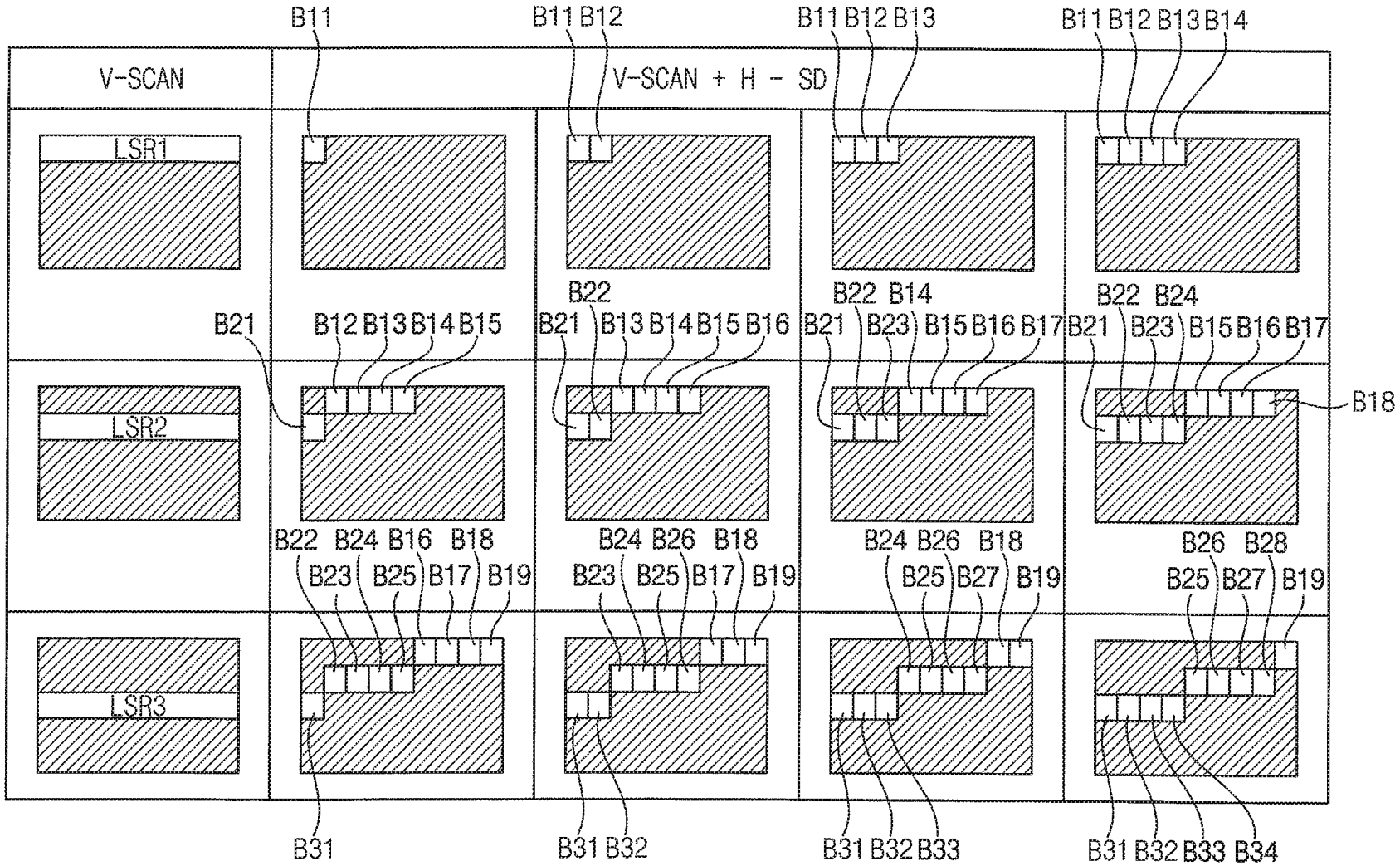
FIG. 5 is a diagram of an operation of a backlight unit of a display device performing only a vertical direction scan operation and an operation of a backlight unit of a display device performing both of a vertical direction scan operation and a horizontal direction sequential driving operation according to driving timings of FIG. 4 according to an example embodiment.
Figure 6:
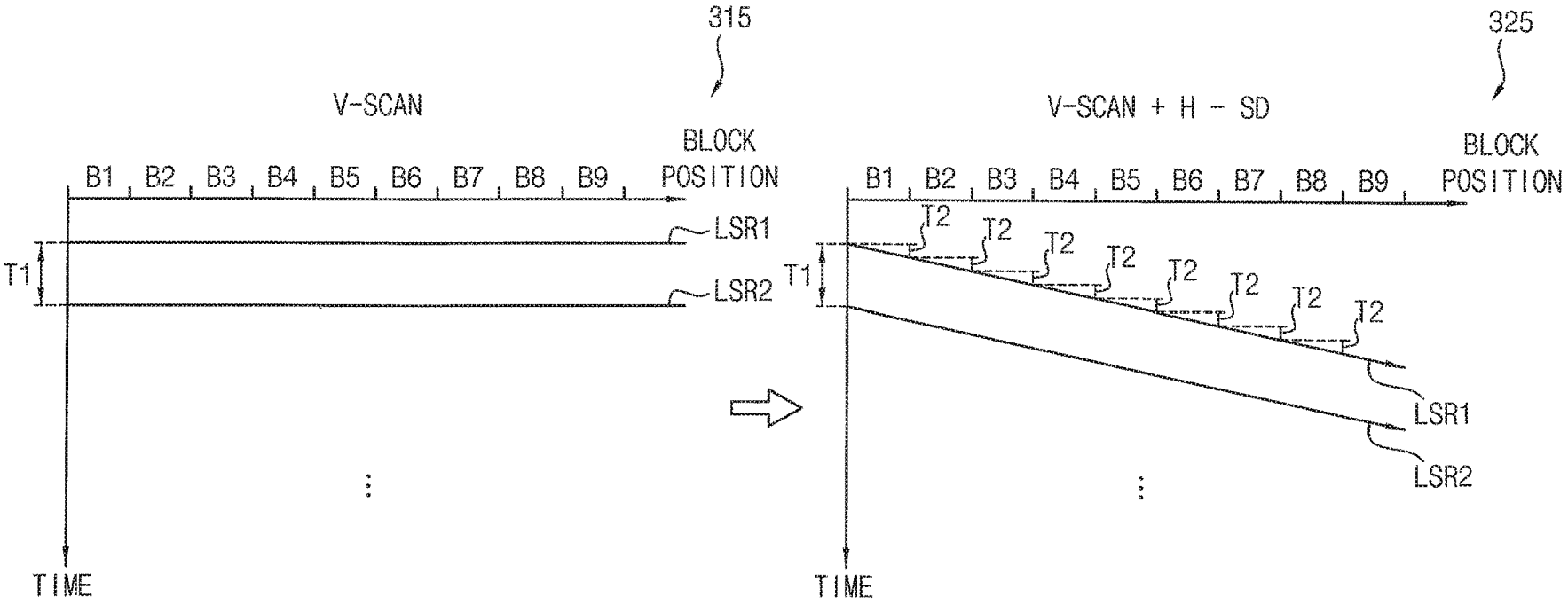
FIG. 6 is a diagram of an operation of a backlight unit of a display device performing only a vertical direction scan operation and an operation of a backlight unit of a display device performing both of a vertical direction scan operation and a horizontal direction sequential driving operation according to an example embodiment.
Figure 7:
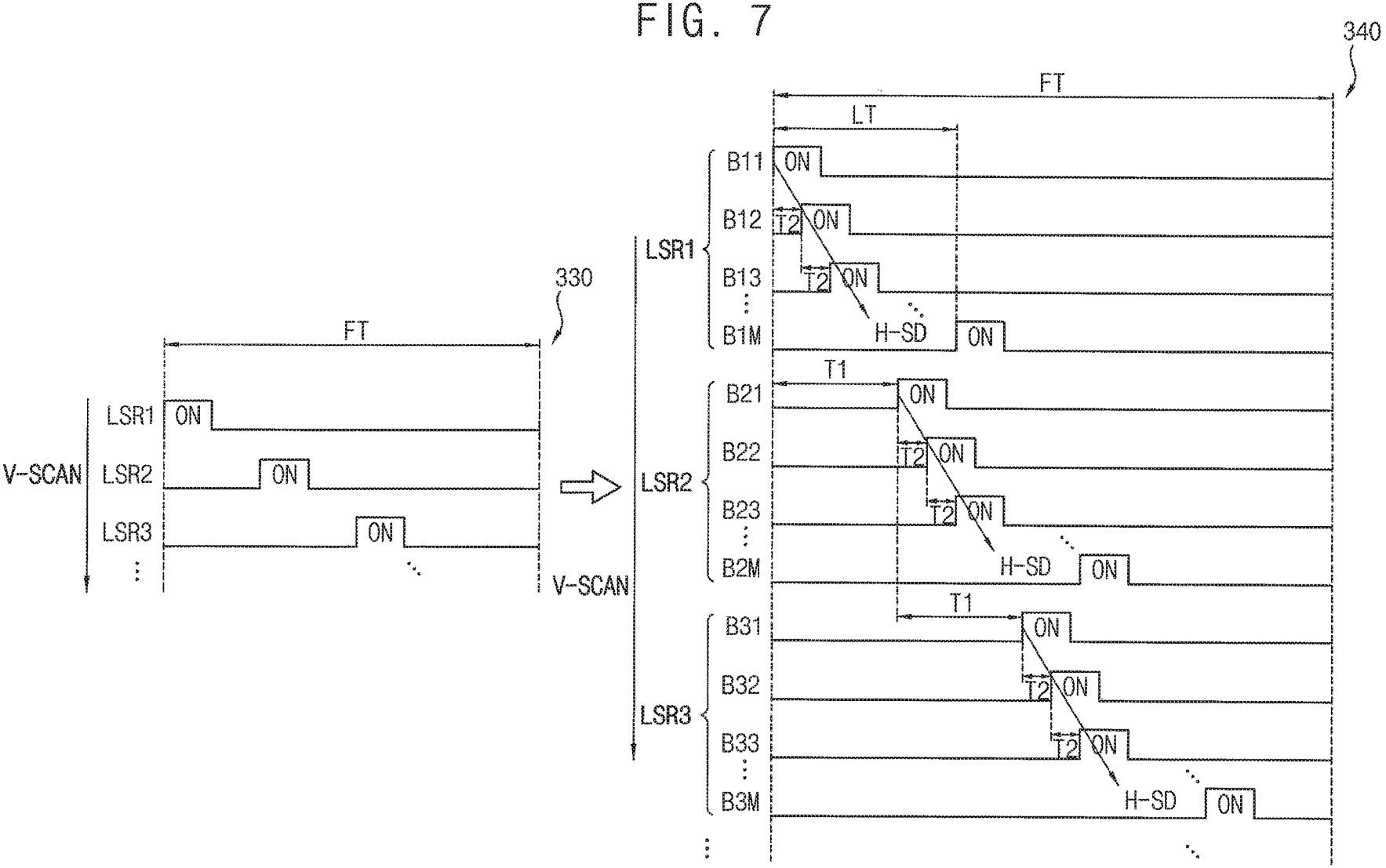
FIG. 7 is a diagram of a driving timing of a backlight unit of a display device performing only a vertical direction scan operation and a driving timing of a backlight unit of a display device performing both of a vertical direction scan operation and a horizontal direction sequential driving operation according to an example embodiment.
Figure 9:
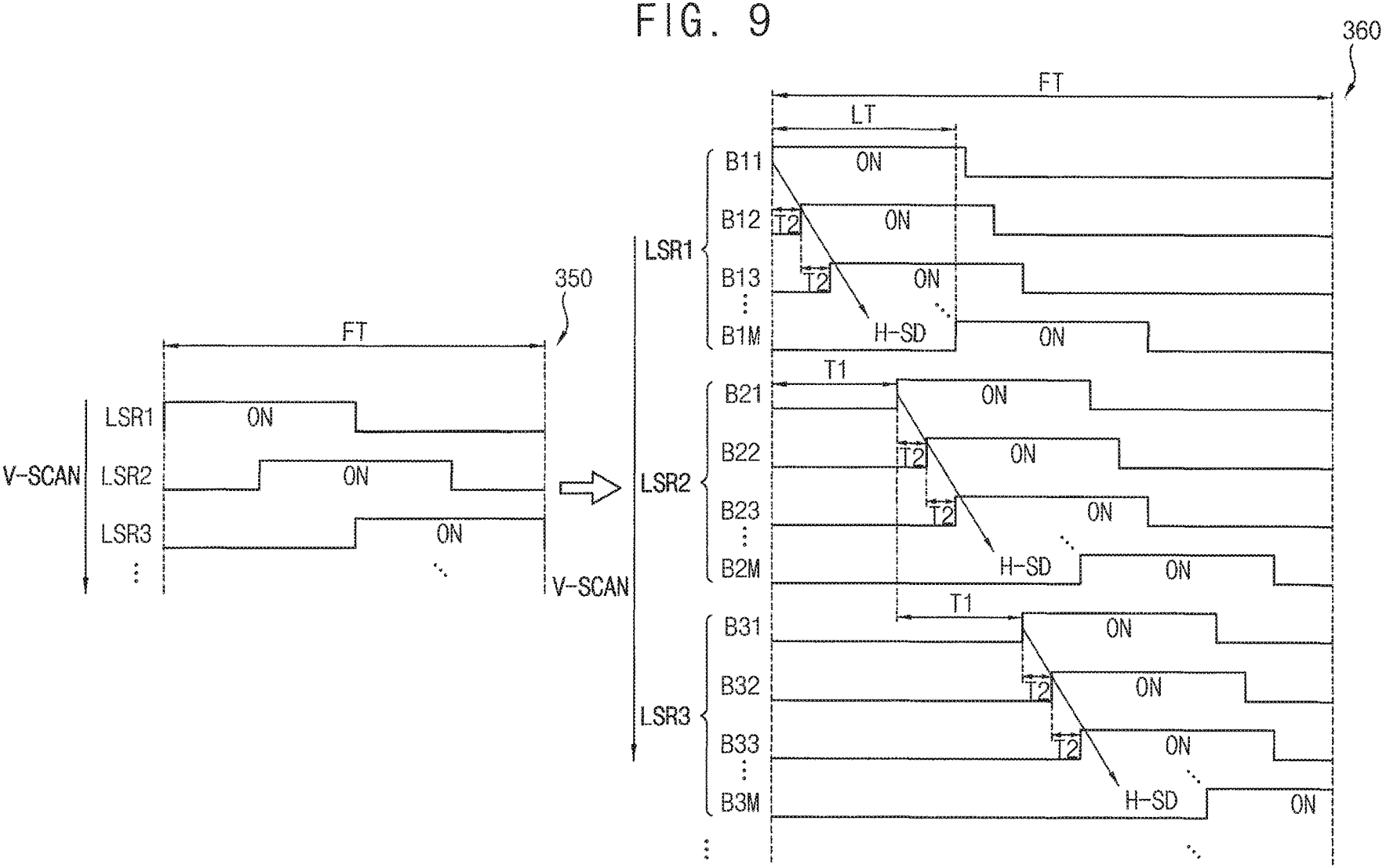
FIG. 9 is a diagram of a driving timing of a backlight unit of a display device performing only a vertical direction scan operation and a driving timing of a backlight unit of a display device performing both of a vertical direction scan operation and a horizontal direction sequential driving operation according to an example embodiment.
Figure 11:
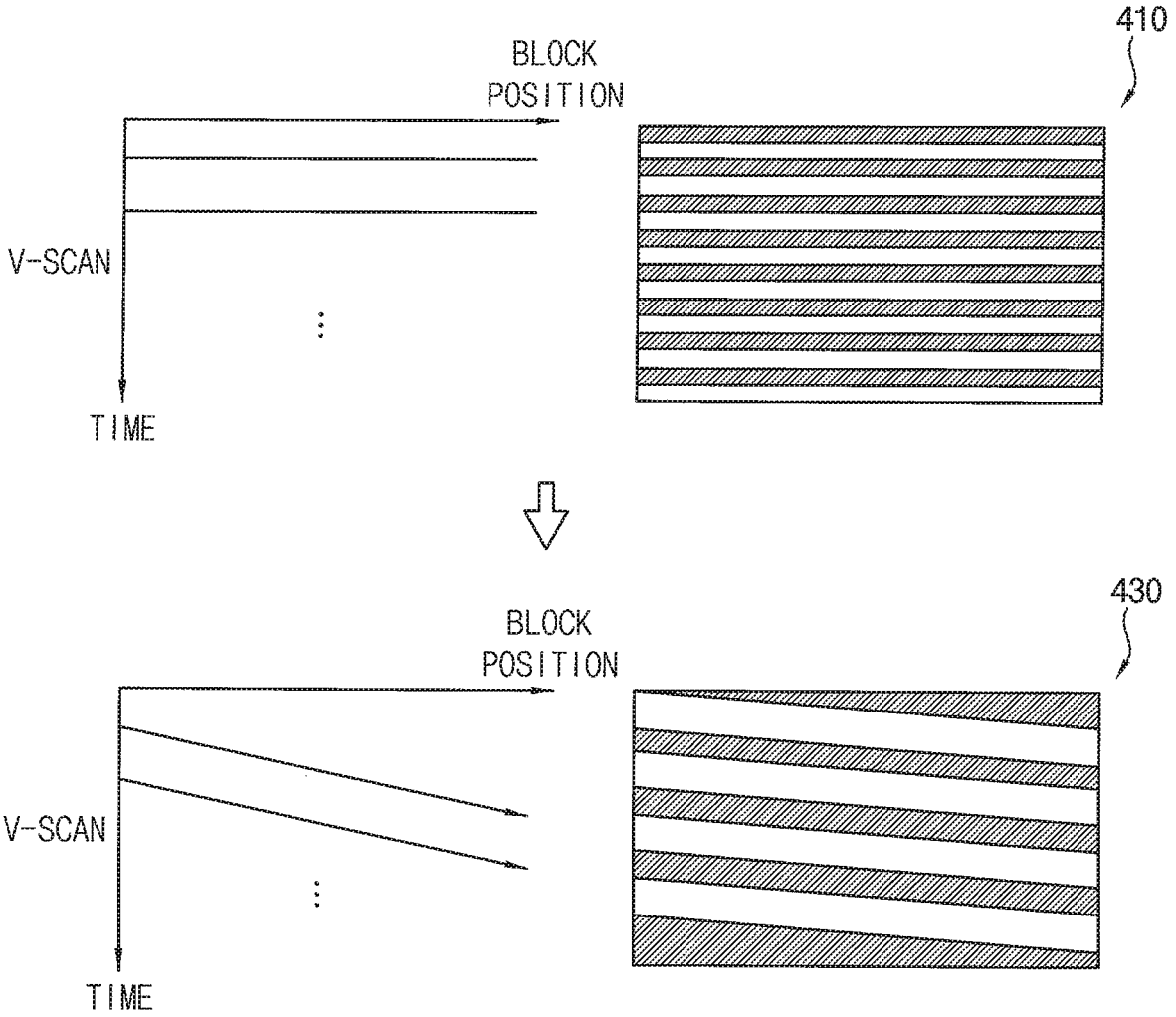
FIG. 11 is a diagram of an image displayed by a display device performing only a vertical direction scan operation and of an image displayed by a display device performing both of a vertical direction scan operation and a horizontal direction sequential driving operation according to an example embodiment.

FIG. 3 is a flowchart of an operation of a display device according to an example embodiment. FIG. 4 is a diagram illustrating driving timing of a backlight unit of a display device performing only a vertical direction scan operation and a driving timing of a backlight unit of a display device performing both of a vertical direction scan operation and a horizontal direction sequential driving operation according to an example embodiment. FIG. 5 is a diagram of an operation of a backlight unit of a display device performing only a vertical direction scan operation and an operation of a backlight unit of a display device performing both of a vertical direction scan operation and a horizontal direction sequential driving operation according to driving timings of FIG. 4 according to an example embodiment. FIG. 6 is a diagram of an operation of a backlight unit of a display device performing only a vertical direction scan operation and an operation of a backlight unit of a display device performing both of a vertical direction scan operation and a horizontal direction sequential driving operation according to an example embodiment. FIG. 7 is a diagram of a driving timing of a backlight unit of a display device performing only a vertical direction scan operation and a driving timing of a backlight unit of a display device performing both of a vertical direction scan operation and a horizontal direction sequential driving operation according to an example embodiment. FIG. 8 is a diagram of luminance influences by adjacent light source blocks of first light source rows according to driving timings of FIG. 7 according to an example embodiment. FIG. 9 is a diagram of a driving timing of a backlight unit of a display device performing only a vertical direction scan operation and a driving timing of a backlight unit of a display device performing both of a vertical direction scan operation and a horizontal direction sequential driving operation according to an example embodiment. FIG. 10 is a diagram of luminance influences by adjacent light source blocks of first light source rows according to driving timings of FIG. 9 according to an example embodiment. FIG. 11 is a diagram of an image displayed by a display device performing only a vertical direction scan operation and of an image displayed by a display device performing both of a vertical direction scan operation and a horizontal direction sequential driving operation according to an example embodiment.

Referring to FIGS. 1 and 3, the panel driver 120 of the display device 100 may receive input image data IDAT in an operation S210, and may drive the display panel 110 based on the input image data IDAT in an operation S230. For example, the controller 150 may provide the data driver 130 with output image data ODAT corresponding to the input image data IDAT, the data driver 130 may provide the display panel 110 with data signals DS corresponding to the output image data ODAT, and the gate driver 140 may provide the display panel 110 with gate signals GS. Transmittance, or transmission factors, of the pixels PX of the display panel 110 may be adjusted based on the data signals DS and the gate signals GS. Further, the controller 150 may provide the backlight driver 170 with a dimming signal SDIM representing that local dimming is to be performed.

The backlight driver 170 may perform a vertical direction scan operation and a horizontal direction sequential driving operation for the backlight unit 160 in response to the dimming signal SDIM in an operation S250. The vertical direction scan operation may be an operation that sequentially selects light source rows included in the backlight unit 160 in a vertical direction, e.g., a direction of each data line, and the horizontal direction sequential driving operation may be an operation that sequentially drives light source blocks included in each light source row in a horizontal direction, e.g., a direction of each gate line.

For example, as illustrated in driving timing 310 of FIG. 4, a display device that performs only a vertical direction scan operation V-SCAN may sequentially drive the light source rows LSR1, LSR2, LSR3, . . . , and light source blocks included in each light source row, e.g., the light source row LSR1, may be substantially simultaneously driven. However, as illustrated in driving timing 320 of FIG. 4, the display device 100 according to example embodiments may perform the vertical direction scan operation V-SCAN that sequentially selects the light source rows LSR1, LSR2, LSR3, . . . , and a horizontal direction sequential driving operation H-SD that sequentially drives the light source blocks, e.g., B11, B12, B13, . . . , B1M, included in each selected light source row, e.g., light source row LSR1.

To perform the vertical direction scan operation V-SCAN, the backlight driver 170 may sequentially select one of the light source rows LSR1, LSR2, LSR3, . . . per first time T1, e.g., based on a first time period. The first time T1 is a first time period, or a length of time, from a time point. A time point is a specific point in time, e.g., a specific point in time when a light source row is selected. For example, the backlight driver 170 may select the second light source row LSR2 after the first time T1 from a time point at which a first light source row LSR1 is selected, and may select the third light source row LSR3 after the first time T1 from a time point at which the second light source row LSR2 is selected. In some example embodiments, the first time T1 may be determined by dividing a frame time FT by the number of the light source rows LSR1, LSR2, LSR3, . . . . The frame time FT is a time period, or length of time, of a frame. For example, in a case where the display device 100 operates at a frame rate of about 120 Hz, and the backlight unit 160 includes 16 light source rows LSR1, LSR2, LSR3, . . . , the frame time FT may be about 8.3 ms (=1/120 ms), and the first time T1 may be about 0.52 ms (=8.3/16 ms).

Further, to perform the horizontal direction sequential driving operation H-SD, the backlight driver 170 may sequentially drive one of the light source blocks, e.g., light source blocks B11, B12, B13, . . . , B1M, included in the selected light source row, e.g., light source row LSR1, per second time T2. The second time T2 is a second time period, or a length of time, from a time point. For example, when the first light source row LSR1 is selected, the light source blocks B11, B12, B13, . . . , B1M of the first light source row LSR1 may be sequentially driven per the second time T2. Further, when the second light source row LSR2 is selected after the first time T1 from the time point at which the first light source row LSR1 is selected, the light source blocks B21, B22, B23, . . . , B2M of the second light source row LSR2 may be sequentially driven per the second time T2. In some example embodiments, as illustrated in FIG. 4, before the horizontal direction sequential driving operation H-SD for the first light source row LSR1 is completed, the second light source row LSR2 may be selected by the vertical direction scan operation V-SCAN, and the horizontal direction sequential driving operation H-SD for the selected second light source row LSR2 may be initiated. Further, when the third light source row LSR3 is selected after the first time T1 from the time point at which the second light source row LSR2 is selected, the light source blocks B31, B32, B33, . . . , B3M of the third light source row LSR3 may be sequentially driven per the second time T2. In some example embodiments, the second time T2 may be determined based on a latency time LT, i.e., a time period, from a data input time point at which the input image data IDAT are input, or a time point at which a vertical start signal STV is generated, to an image display time point at which an image corresponding to the input image data IDAT is displayed. The latency time LT may be previously determined by a standard or a specification of the display device 100. For example, the second time T2 may be determined by dividing the latency time LT by the number of the light source blocks, e.g., light source blocks B11, B12, B13, . . . , B1M, included in each light source row, e.g., light source row LSR1. In an example, in a case where the latency time LT is about 2 ms, and each light source row includes 40 light source blocks, the second time T2 may be about 50 μs (=2000/40 μs). In this case, driving the second light source block B12 of the first light source row LSR1 may be initiated after the second time T2 of about 50 μs from a time point at which driving the first light source block B11 of the first light source row LSR1 is initiated. Further, driving the third light source block B13 of the first light source row LSR1 may be initiated after the second time T2 of about 50 μs from a time point at which driving the second light source block B12 of the first light source row LSR1 is initiated. The second time T2 that is an interval of driving start time points of the light source blocks in each light source row may be referred to as a block shift time or a phase shift time.

In the display device that performs only the vertical direction scan operation V-SCAN and the display device 100 that performs the vertical direction scan operation V-SCAN and the horizontal direction sequential driving operation H-SD, the backlight unit 160 may operate as illustrated in FIG. 5 by driving timings 310 and 320 of FIG. 4. That is, in the display device that operates according to the driving timing 310, the first light source row LSR1 may emit light, and, after the first time T1, the second light source row LSR2 may emit light. Then, after the first time T1, the third light source row LSR3 may emit light.

However, in the display device 100 that operates according to the driving timing 320, light emission of a first light source block B11 of the first light source row LSR1 may be initiated. Light emission of a second light source block B12 of the first light source row LSR1 may be initiated after the second time T2. Light emission of a third light source block B13 of the first light source row LSR1 may be initiated after the second time T2. Light emission of a fourth light source block B14 of the first light source row LSR1 may be initiated after the second time T2.

Then, light emission of a first light source block B21 of the second light source row LSR2 and a fifth light source block B15 of the first light source row LSR1 may be initiated. Light emission of a second light source block B22 of the second light source row LSR2 and a sixth light source block B16 of the first light source row LSR1 may be initiated after the second time T2. Light emission of a third light source block B23 of the second light source row LSR2 and a seventh light source block B17 of the first light source row LSR1 may be initiated after the second time T2. Light emission of a fourth light source block B24 of the second light source row LSR2 and an eighth light source block B18 of the first light source row LSR1 may be initiated after the second time T2.

Then, light emission of a first light source block B31 of the third light source row LSR3, a fifth light source block B25 of the second light source row LSR2 and a ninth light source block B19 of the first light source row LSR1 may be initiated. Light emission of a second light source block B32 of the third light source row LSR3 and a sixth light source block B26 of the second light source row LSR2 may be initiated after the second time T2. Light emission of a third light source block B33 of the third light source row LSR3 and a seventh light source block B27 of the second light source row LSR2 may be initiated after the second time T2. Light emission of a fourth light source block B34 of the third light source row LSR3 and an eighth light source block B28 of the second light source row LSR2 may be initiated after the second time T2.

An operation of the display device that performs only the vertical direction scan operation V-SCAN and the display device 100 that performs the vertical direction scan operation V-SCAN and the horizontal direction sequential driving operation H-SD may be expressed as graphs 315 and 325 in FIG. 6. That is, in the display device that performs only the vertical direction scan operation V-SCAN, as illustrated as the graph 315 in FIG. 6, the light source blocks B1 through B9 of the first light source row LSR1 may substantially simultaneously emit light, and, after the first time T1, the light source blocks B1 through B9 of the second light source row LSR2 may substantially simultaneously emit light.

However, in the display device 100 that performs the vertical direction scan operation V-SCAN and the horizontal direction sequential driving operation H-SD, as illustrated as the graph 325 in FIG. 6, the light source rows LSR1, LSR2, . . . may be sequentially selected per the first time T1, and the light source blocks B1 through B9 of each of the sequentially selected light source rows LSR1, LSR2, . . . may be sequentially driven per the second time T2.

Luminance influence of adjacent light source blocks on each light source block in the display device 100 may be reduced compared with the luminance influence of the adjacent light source blocks on each light source block in the display device that performs only the vertical direction scan operation V-SCAN. For example, FIG. 8 illustrates the luminance influence of the adjacent light source blocks on each light source block of the first light source row LSR1 in display devices that operate according to driving timings 330 and 340 illustrated in FIG. 7. FIG. 10 illustrates the luminance influence of the adjacent light source blocks on each light source block of the first light source row LSR1 in display devices that operate according to driving timings 350 and 360 illustrated in FIG. 9. In FIGS. 8 and 10, each of light source blocks B11 through B19 of the first light source row LSR1 may be equally divided into four regions along the vertical direction, and the luminance influence of the adjacent light source blocks at the equally divided four regions of each light source block B11 through B19 may be expressed as numerical values. Further, the values of the luminance influence of the adjacent light source blocks illustrated in FIGS. 8 and 10 may be relative values, and may not have a particular unit, or measure. For example, the values of the luminance influence of the adjacent light source blocks illustrated in FIGS. 8 and 10 may be determined by assuming luminance of one light source block emitting light as 1.

For example, as illustrated in the driving timing 330 of FIG. 7, in a case where the light source rows LSR1, LSR2, LSR3, . . . sequentially emit light, and a light emission time of each light source row, e.g., light source row LSR1, corresponding to a half of the first time T1, as illustrated in diagram 335 of FIG. 8, lower half regions of the light source blocks B11 through B19 of the first light source row LSR1 may be affected by the luminance influence ranging from about 1.75 to about 2.5. However, as illustrated in the driving timing 340 of FIG. 7, in a case where the light source rows LSR1, LSR2, LSR3, . . . are sequentially selected, and the light source blocks B11 through B19 of each selected light source row, e.g., light source row LSR1, are sequentially driven, as illustrated in diagram 345 of FIG. 8, lower half regions of the light source blocks B11 through B19 of the first light source row LSR1 may be affected by the luminance influence ranging from about 0 to about 1.5. Accordingly, compared with the display device that performs only the vertical direction scan operation V-SCAN, the luminance influence of the adjacent light source blocks on each light source block in the display device 100 may be reduced.

Further, for example, as illustrated in the driving timing 350 of FIG. 9, in a case where the light source rows LSR1, LSR2, LSR3, . . . sequentially emit light, and a light emission time of each light source row, e.g., light source row LSR1, corresponding to a double of the first time T1, as illustrated in diagram 355 of FIG. 10, the divided regions of the light source blocks B11 through B19 of the first light source row LSR1 may be affected by the luminance influence ranging from about 1.75 to about 3.85. However, as illustrated in the driving timing 360 of FIG. 9, in a case where the light source rows LSR1, LSR2, LSR3, . . . are sequentially selected, and the light source blocks B11 through B19 of each selected light source row, e.g., light source row LSR1, are sequentially driven, as illustrated in diagram 365 of FIG. 10, the divided regions of the light source blocks B11 through B19 of the first light source row LSR1 may be affected by the luminance influence ranging from about 0 to about 3.05. Accordingly, compared with the display device that performs only the vertical direction scan operation V-SCAN, the luminance influence of the adjacent light source blocks on each light source block in the display device 100 according to example embodiments may be reduced.

As illustrated in FIG. 11, in an image 410 displayed at the display device that performs only the vertical direction scan operation V-SCAN, a waterfall phenomenon where a relatively high or low luminance horizontal line image exists or gradually moves may occur. However, by the reduction of the luminance influence of the adjacent light source blocks, in an image 430 displayed at the display device 100 that performs the vertical direction scan operation V-SCAN and the horizontal direction sequential driving operation H-SD, the waterfall phenomenon may be prevented or reduced.

Figure 12:
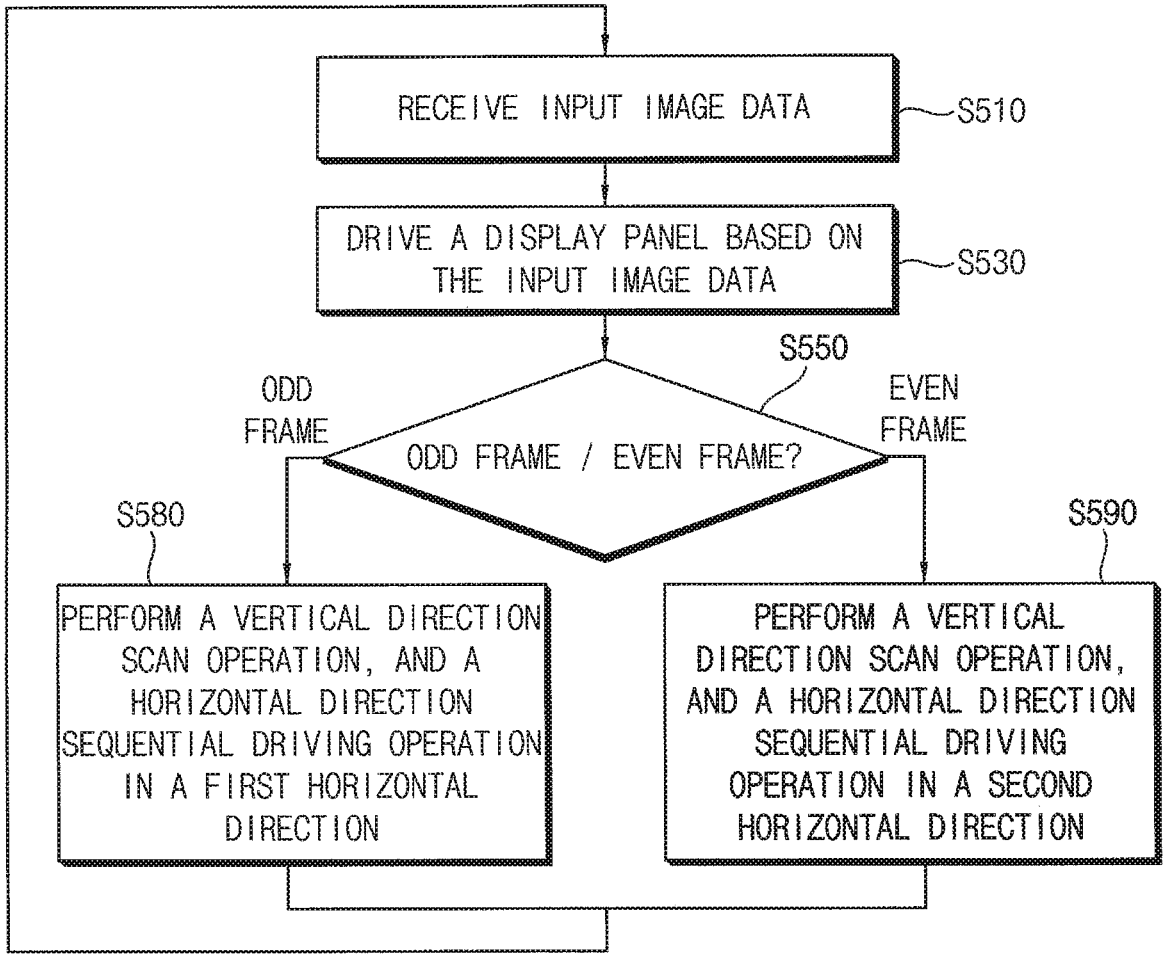
FIG. 12 is a flowchart of an operation of a display device according to an example embodiment.
Figure 13:
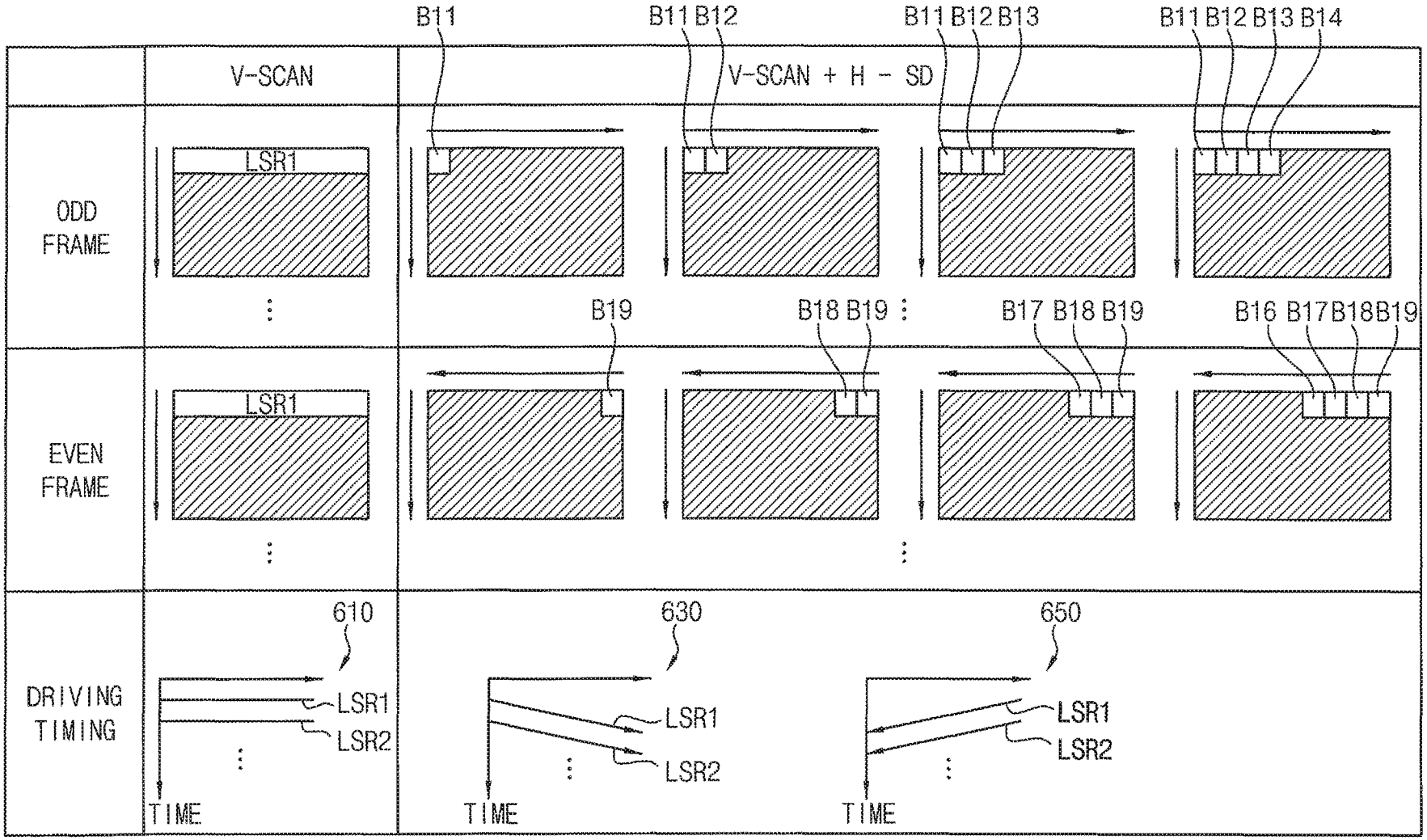
FIG. 13 is a diagram of an operation of a backlight unit of a display device performing only a vertical direction scan operation and of an operation of a backlight unit of a display device performing an operation of FIG. 12 according to an example embodiment.
Figure 14:
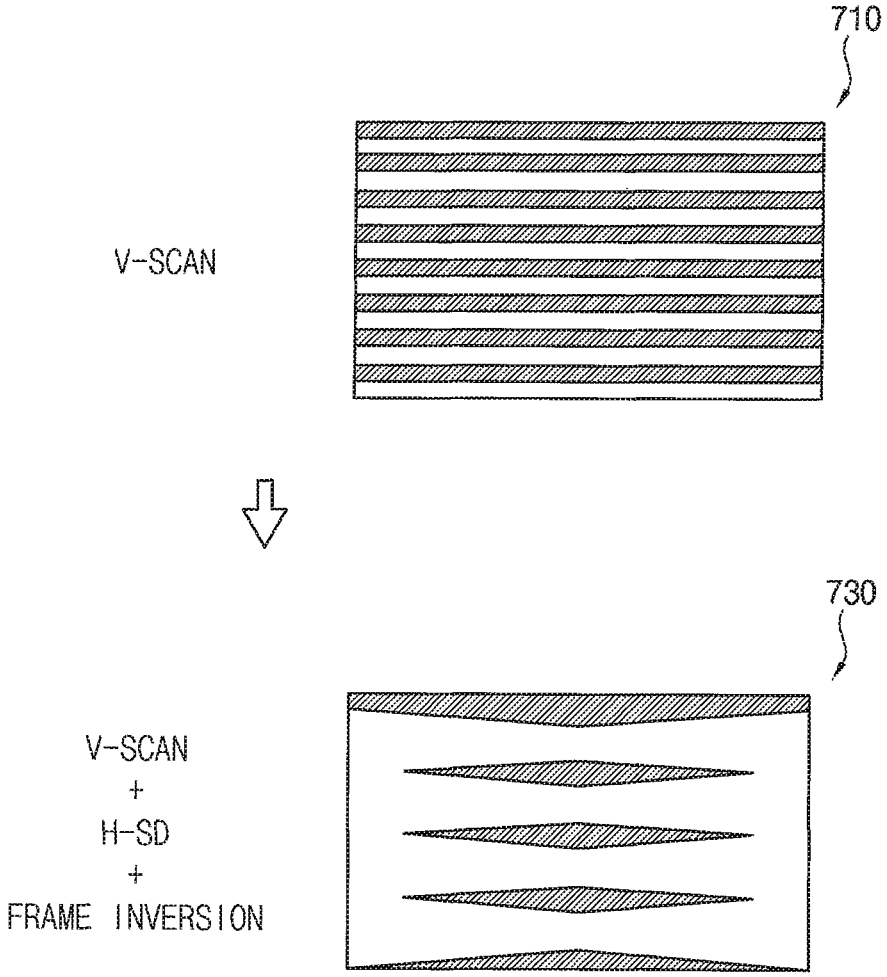
FIG. 14 is a diagram of an image displayed by a display device performing only a vertical direction scan operation and of an image displayed by a display device performing an operation of FIG. 12 according to an example embodiment.

FIG. 12 is a flowchart of an operation of a display device according to an example embodiment. FIG. 13 is a diagram of an operation of a backlight unit of a display device performing only a vertical direction scan operation and of an operation of a backlight unit of a display device performing an operation of FIG. 12 according to an example embodiment. FIG. 14 is a diagram of an image displayed by a display device performing only a vertical direction scan operation and an image displayed by a display device performing an operation of FIG. 12 according to an example embodiment.

Referring to FIGS. 1 and 12, the panel driver 120 of the display device 100 may receive input image data IDAT in an operation S510, and may drive the display panel 110 based on the input image data IDAT in an operation S530.

The backlight driver 170 may perform, in an odd-numbered frame, a vertical direction scan operation, and a horizontal direction sequential driving operation in a first horizontal direction in an operation S550: ODD FRAME, and in an operation S580, and may perform, in an even-numbered frame, the vertical direction scan operation, and the horizontal direction sequential driving operation in a second horizontal direction opposite to the first horizontal direction in operation S550: EVEN FRAME, and in an operation S590. In some example embodiments, each light source row of a backlight unit 160 may include first through M-th light source blocks, the horizontal direction sequential driving operation in the first horizontal direction may be an operation that sequentially drives the first through M-th light source blocks in an order from the first light source block to the M-th light source block, and the horizontal direction sequential driving operation in the second horizontal direction may be an operation that sequentially drives the first through M-th light source blocks in an order from the M-th light source block to the first light source block.

For example, as illustrated as a graph 610 in FIG. 13, in a display device that performs only the vertical direction scan operation V-SCAN, the light source rows LSR1, LSR2, . . . may sequentially emit light, and the light emission operation in the odd-numbered frame may be the same as the light emission operation in the even-numbered frame. However, in the display device 100 that performs the operation of FIG. 12, the light source blocks B11 through B19 of each light source row LSR1 may sequentially emit light in the first horizontal direction from the leftmost light source block B11 in the odd-numbered frame. The vertical direction scan operation V-SCAN and the horizontal direction sequential driving operation H-SD in the first horizontal direction in the odd-numbered frame may be expressed as a graph 630 in FIG. 13. Further, in the display device 100 that performs the operation of FIG. 12, the light source blocks B11 through B19 of each light source row LSR1 may sequentially emit light in the second horizontal direction from the rightmost light source block B19 in the even-numbered frame. The vertical direction scan operation V-SCAN and the horizontal direction sequential driving operation H-SD in the second horizontal direction in the even-numbered frame may be expressed as a graph 650 in FIG. 13. That is, in the display device 100 that performs the operation of FIG. 12, the directions of the horizontal direction sequential driving operation H-SD may be inverted in the odd-numbered frame and the even-numbered frame, and this operation may be referred to as a frame inversion operation.

As illustrated in FIG. 14, in an image 710 displayed at the display device that performs only the vertical direction scan operation V-SCAN, a waterfall phenomenon where a relatively high or low luminance horizontal line image exists or gradually moves may occur. However, in an image 730 displayed at the display device 100 that performs the vertical direction scan operation V-SCAN, the horizontal direction sequential driving operation H-SD and the frame inversion operation, the waterfall phenomenon may be prevented or reduced.

Figure 15:
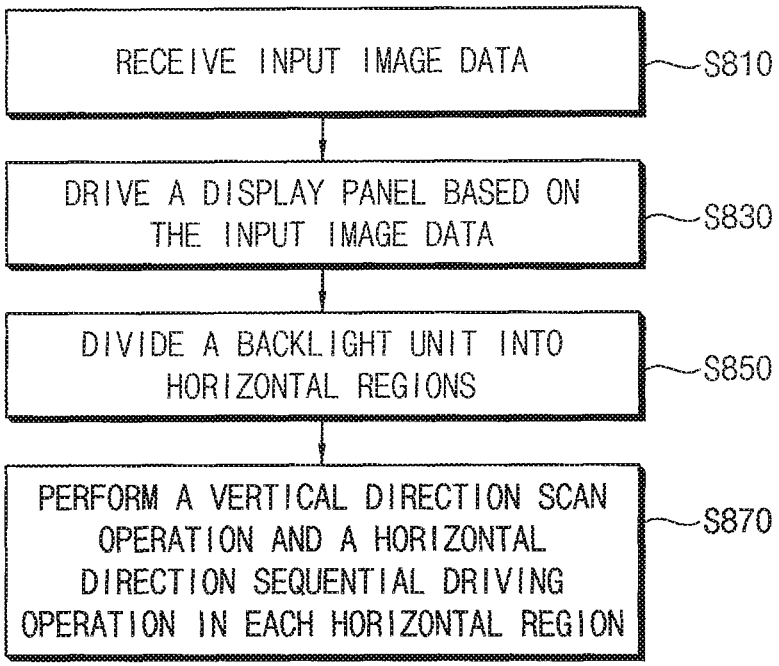
FIG. 15 is a flowchart of an operation of a display device according to an example embodiment.
Figure 16:
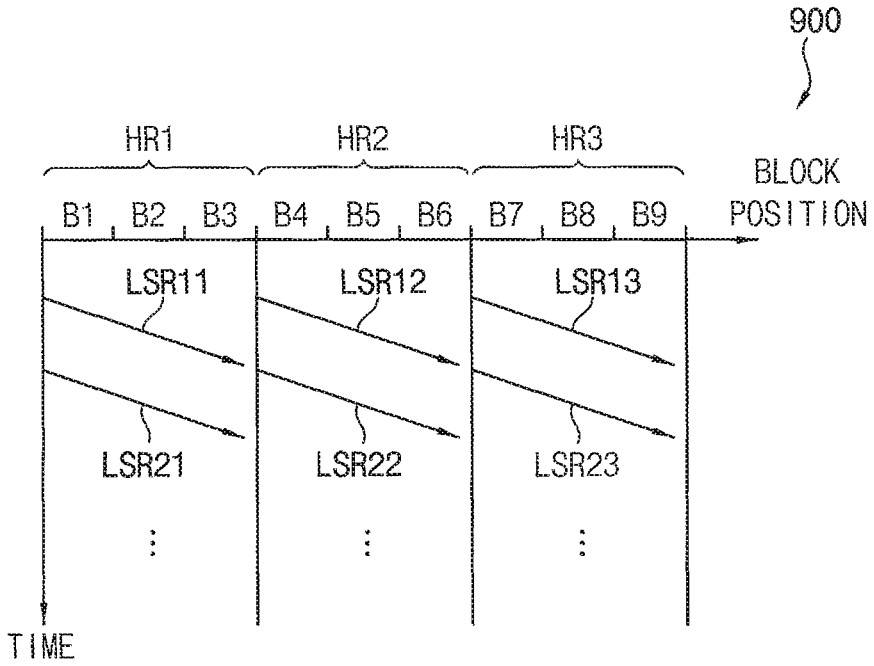
FIG. 16 is a diagram of an operation of a backlight unit of a display device performing an operation of FIG. 15 according to an example embodiment.

FIG. 15 is a flowchart of an operation of a display device according to an example embodiment. FIG. 16 is a diagram of an operation of a backlight unit of a display device performing an operation of FIG. 15 according to an example embodiment.

Referring to FIGS. 1 and 15, the panel driver 120 of the display device 100 may receive input image data IDAT in an operation S810, and may drive a display panel 110 based on the input image data IDAT in an operation S830.

The backlight driver 170 may divide the backlight unit 160 into horizontal regions in an operation S850, and may perform, in each horizontal region, a vertical direction scan operation that sequentially selects the light source rows of the backlight unit 160 and a horizontal direction sequential driving operation that sequentially drives the light source blocks included in the selected light source row in an operation S870. Here, each horizontal region may include two or more consecutive light source columns of the backlight unit 160.

For example, as illustrated as a graph 900 in FIG. 16, the backlight driver 170 may divide the backlight unit 160 into a first horizontal region HR1 including first through third light source blocks B1, B2 and B3 of each light source row, a second horizontal region HR2 including fourth through sixth light source blocks B4, B5 and B6 of each light source row, and a third horizontal region HR3 including seventh through ninth light source blocks B7, B8 and B9 of each light source row. With respect to the first horizontal region HR1, the backlight driver 170 may perform the vertical direction scan operation that sequentially select the light source rows, and the horizontal direction sequential driving operation that sequentially drives the first through third light source blocks B1, B2 and B3 included in each of portions LSR11, LSR21, . . . of the sequentially selected light source rows in the first horizontal region HR1. With respect to the second horizontal region HR2, the backlight driver 170 may perform the vertical direction scan operation that sequentially select the light source rows, and the horizontal direction sequential driving operation that sequentially drives the fourth through sixth light source blocks B4, B5 and B6 included in each of portions LSR12, LSR22, . . . of the sequentially selected light source rows in the second horizontal region HR2. With respect to the third horizontal region HR3, the backlight driver 170 may perform the vertical direction scan operation that sequentially select the light source rows, and the horizontal direction sequential driving operation that sequentially drives the seventh through ninth light source blocks B7, B8 and B9 included in each of portions LSR13, LSR23, . . . of the sequentially selected light source rows in the third horizontal region HR3.

FIG. 16 illustrates an example where each light source row includes nine light source blocks B1 through B9, and each horizontal region HR1, HR2 and HR3 includes three light source columns, the number of light source blocks B1 through B9 in each light source row may be different, the number of the horizontal regions HR1, HR2 and HR3 may be different, and the number of the light source columns in each horizontal region HR1, HR2 and HR3 may be different.

As described above with reference to FIGS. 3 through 11, in the display device 100 that performs an operation illustrated in FIG. 3, a second time T2, i.e., a block shift time or a phase shift time, that is an interval of driving start time points of the light source blocks in each light source row may be determined by dividing a latency time LT by the number of the light source blocks in each light source row. Thus, as the number of the light source blocks in each light source row increases, the block shift time may be decreased. If the block shift time is decreased, luminance influence of an adjacent light source block on each light source block may be increased.

However, in the display device 100 that performs an operation illustrated in FIG. 15, the backlight unit 160 may be divided into the horizontal regions HR1, HR2 and HR3, and, in each horizontal region, e.g., horizontal region HR1, the horizontal direction sequential driving operation that sequentially drives the light source blocks, e.g., light source blocks B1, B2 and B3, included in the selected light source row, e.g., light source row LSR11, may be performed. Thus, the block shift time may be determined by dividing the latency time LT by the number of the light source blocks, e.g., light source blocks B1, B2 and B3, included in each light source row in each horizontal region, e.g., horizontal region HR1. That is, the block shift time in the display device 100 that performs the operation illustrated in FIG. 15 may correspond to a multiplication of the block shift time in the display device 100 that performs the operation illustrated in FIG. 3 by the number of the horizontal regions HR1, HR2 and HR3. Accordingly, in the display device 100 that performs the operation illustrated in FIG. 15, the luminance influence of the adjacent light source block on each light source block may be reduced, and a waterfall phenomenon may be prevented or reduced while local dimming is performed.

Figure 17:
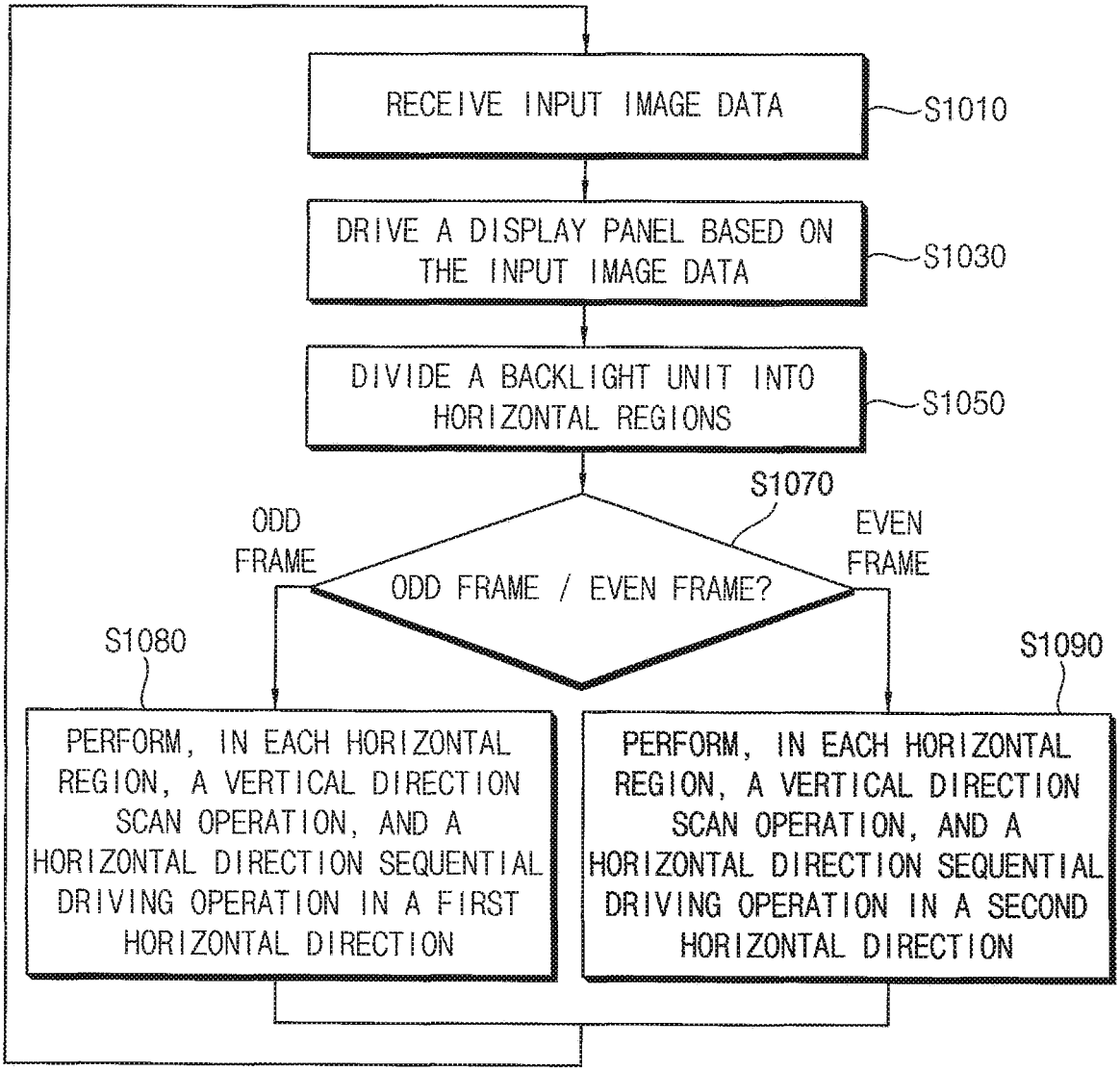
FIG. 17 is a flowchart of an operation of a display device according to an example embodiment.
Figure 18:
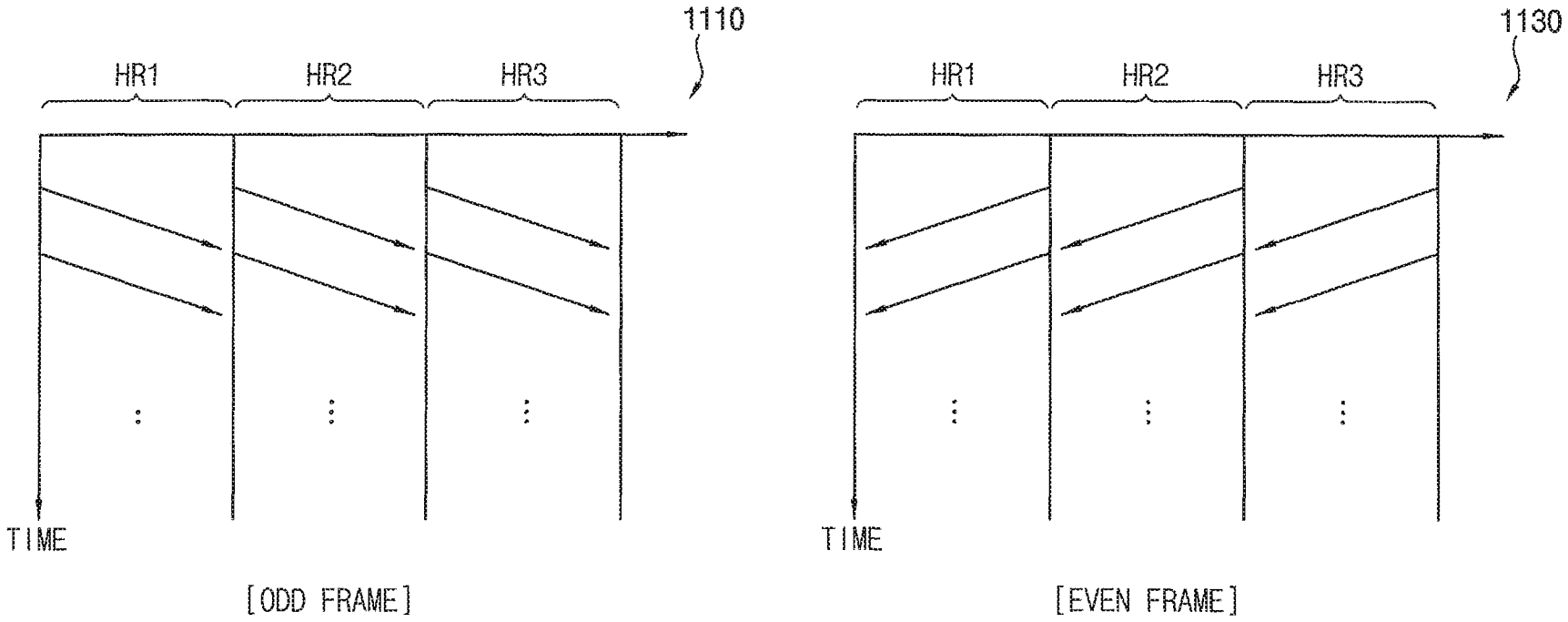
FIG. 18 is a diagram of an operation of a backlight unit of a display device performing an operation of FIG. 17 according to an example embodiment.

FIG. 17 is a flowchart of an operation of a display device according to an example embodiment. FIG. 18 is a diagram of an operation of a backlight unit of a display device performing an operation of FIG. 17 according to an example embodiment.

Referring to FIGS. 1 and 17, the panel driver 120 of the display device 100 may receive input image data IDAT in an operation S1010, and may drive the display panel 110 based on the input image data IDAT in an operation S1030.

The backlight driver 170 may divide the backlight unit 160 into horizontal regions in an operation S1050, and may perform a vertical direction scan operation and a horizontal direction sequential driving operation in each horizontal region. Compared with a display device 100 performing an operation illustrated in FIG. 15, the display device 100 performing an operation illustrated in FIG. 17 may further perform a frame inversion operation. Thus, to perform the horizontal direction sequential driving operation in each horizontal region, the backlight driver 170 of the display device 100 performing the operation illustrated in FIG. 17 may sequentially drive the light source blocks in a selected light source row within the horizontal region in a first horizontal direction in an odd-numbered frame in an operation S1070: ODD FRAME, and in an operation S1080, and may sequentially drive the light source blocks in the selected light source rows within the horizontal region in a second horizontal direction opposite to the first horizontal direction in an even-numbered frame in the operation S1070: EVEN FRAME, and in an operation S1090.

For example, as illustrated as a graph 1110 in FIG. 18, in each of the horizontal regions HR1, HR2 and HR3, the vertical direction scan operation and the horizontal direction sequential driving operation in the first horizontal direction from a left light source block to a right light source block may be performed in the odd-numbered frame. Further, as illustrated as a graph 1130 in FIG. 18, in each of the horizontal regions HR1, HR2 and HR3, the vertical direction scan operation and the horizontal direction sequential driving operation in the second horizontal direction from the right light source block to the left light source block may be performed in the even-numbered frame. Accordingly, in the display device 100 that performs the operation illustrated in FIG. 17, the frame inversion operation may be further performed, and a waterfall phenomenon may be further prevented or reduced while local dimming is performed.

Figure 19:
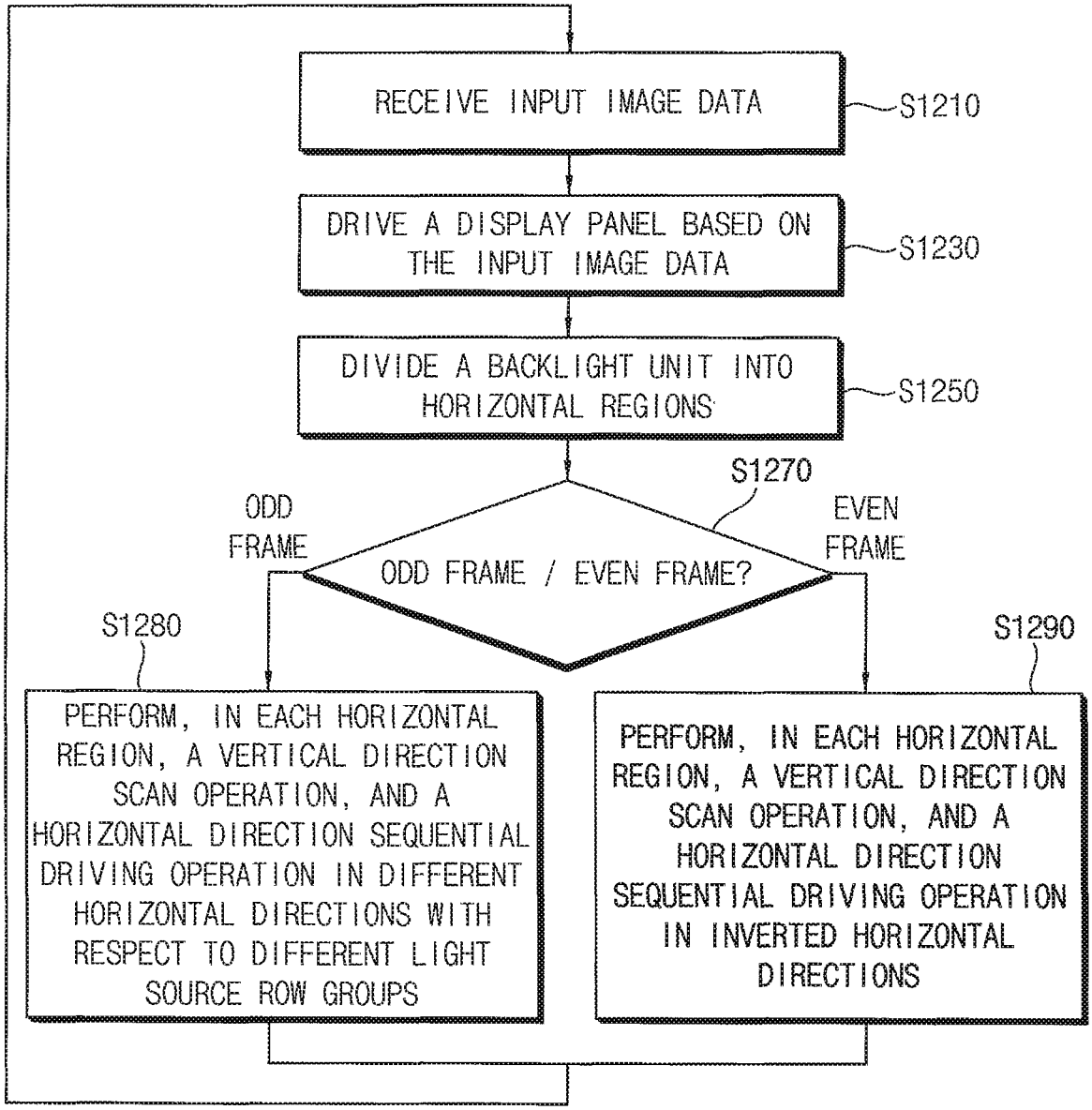
FIG. 19 is a flowchart of an operation of a display device according to an example embodiment.
Figure 20:
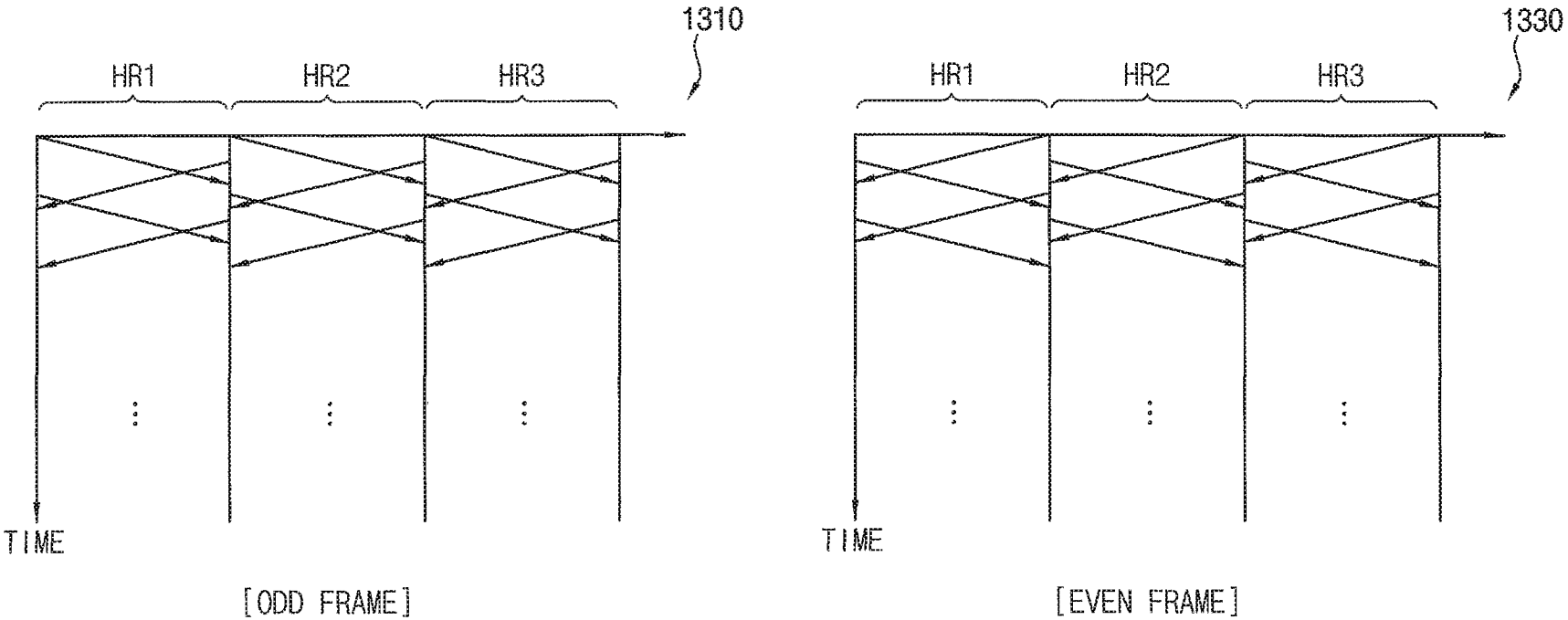
FIG. 20 is a diagram of an operation of a backlight unit of a display device performing an operation of FIG. 19 according to an example embodiment.
Figure 21:
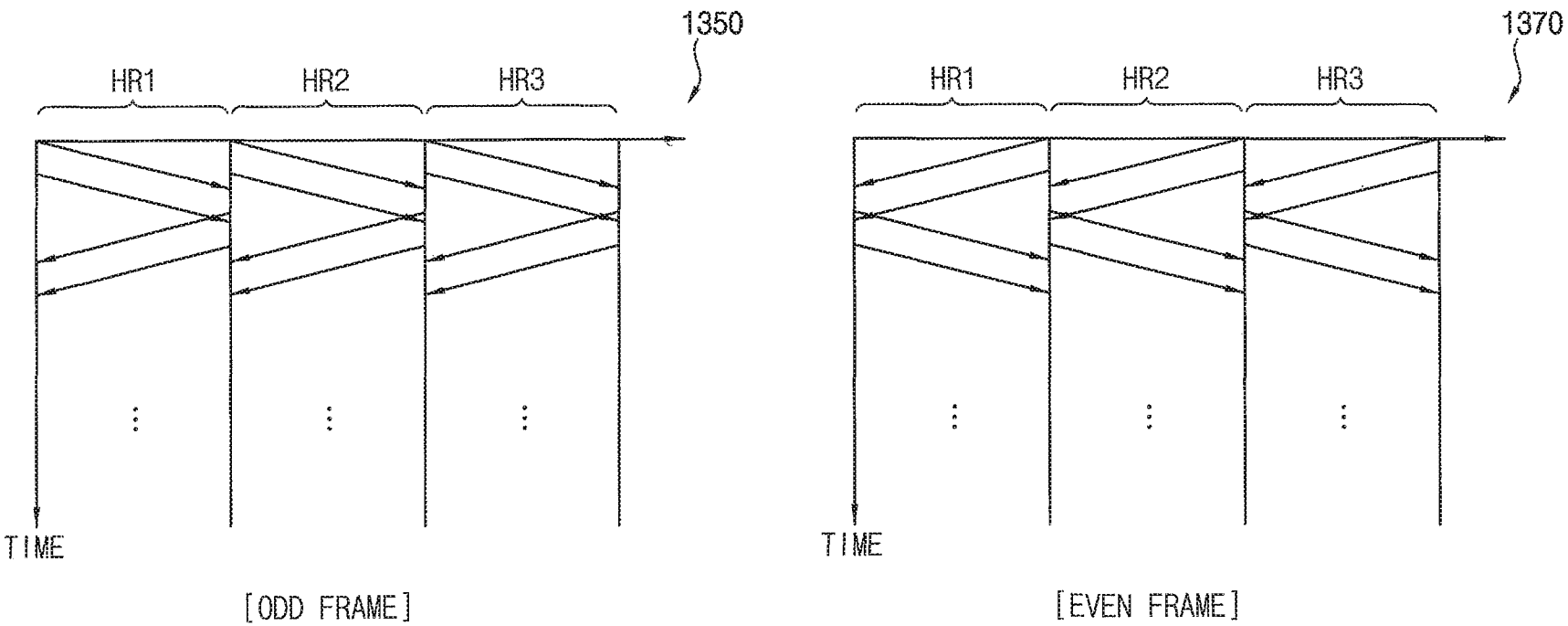
FIG. 21 is a diagram of an operation of a backlight unit of a display device performing an operation of FIG. 19 according to an example embodiment.

FIG. 19 is a flowchart of an operation of a display device according to an example embodiment. FIG. 20 is a diagram of an operation of a backlight unit of a display device performing an operation of FIG. 19 according to an example embodiment. FIG. 21 is a diagram of an operation of a backlight unit of a display device performing an operation of FIG. 19 according to an example embodiment.

Referring to FIGS. 1 and 19, the panel driver 120 of the display device 100 may receive input image data IDAT in an operation S1210, and may drive the display panel 110 based on the input image data IDAT in an operation S1230.

The backlight driver 170 may divide the backlight unit 160 into horizontal regions in an operation S1250, may perform a vertical direction scan operation and a horizontal direction sequential driving operation in each horizontal region, and may further perform a frame inversion operation. Unlike the display device 100 performing an operation illustrated in FIG. 17, the display device 100 performing an operation illustrated in FIG. 19 may group light source rows of the backlight unit 160 into two light source groups, and may perform, in each horizontal region, the horizontal direction sequential driving operation in different horizontal directions with respect to the two light source groups.

In some example embodiments, as illustrated in FIG. 20, the backlight driver 170 may group the light source rows into an odd-numbered light source row group and an even-numbered light source row group. As illustrated as a graph 1310 in FIG. 20, to perform the horizontal direction sequential driving operation in each of the horizontal regions HR1, HR2 and HR3 in an odd-numbered frame, the backlight driver 170 may sequentially drive the light source blocks in a selected light source row belonging to the odd-numbered light source row group in each horizontal region HR1, HR2 and HR3 in a first horizontal direction from a left light source block to a right light source block, and may sequentially drive the light source blocks in the selected light source row belonging to the even-numbered light source row group in each horizontal region HR1, HR2 and HR3 in a second horizontal direction from the right light source block to the left light source block in an operation S1270: ODD FRAME, and in an operation S1280. Further, as illustrated as a graph 1330 in FIG. 20, to perform the horizontal direction sequential driving operation in each of the horizontal regions HR1, HR2 and HR3 in an even-numbered frame, the backlight driver 170 may sequentially drive the light source blocks in the selected light source row belonging to the odd-numbered light source row group in each horizontal region HR1, HR2 and HR3 in the second horizontal direction, and may sequentially drive the light source blocks in the selected light source row belonging to the even-numbered light source row group in each horizontal region HR1, HR2 and HR3 in the first horizontal direction in the operation S1270: EVEN FRAME, and in an operation S1290.

In other example embodiments, as illustrated in FIG. 21, the backlight driver 170 may group (4K+1)-th and (4K+2)-th light source rows of the light source rows into a first light source row group, and may group (4K+3)-th and (4K+4)-th light source rows of the light source rows into a second light source row group, where K is an integer greater than 0. As illustrated as a graph 1350 in FIG. 21, to perform the horizontal direction sequential driving operation in each of the horizontal regions HR1, HR2 and HR3 in the odd-numbered frame, the backlight driver 170 may sequentially drive the light source blocks in the selected light source row belonging to the first light source row group in each horizontal region HR1, HR2 and HR3 in the first horizontal direction, and may sequentially drive the light source blocks in the selected light source row belonging to the second light source row group in each horizontal region HR1, HR2 and HR3 in the second horizontal direction in the operation S1270: ODD FRAME, and in the operation S1280. Further, as illustrated as a graph 1370 in FIG. 21, to perform the horizontal direction sequential driving operation in each of the horizontal regions HR1, HR2 and HR3 in the even-numbered frame, the backlight driver 170 may sequentially drive the light source blocks in the selected light source row belonging to the first light source row group in each horizontal region HR1, HR2 and HR3 in the second horizontal direction, and may sequentially drive the light source blocks in the selected light source row belonging to the second light source row group in each horizontal region HR1, HR2 and HR3 in the first horizontal direction in the operation S1270: EVEN FRAME, and in the operation S1290.

Figure 22:
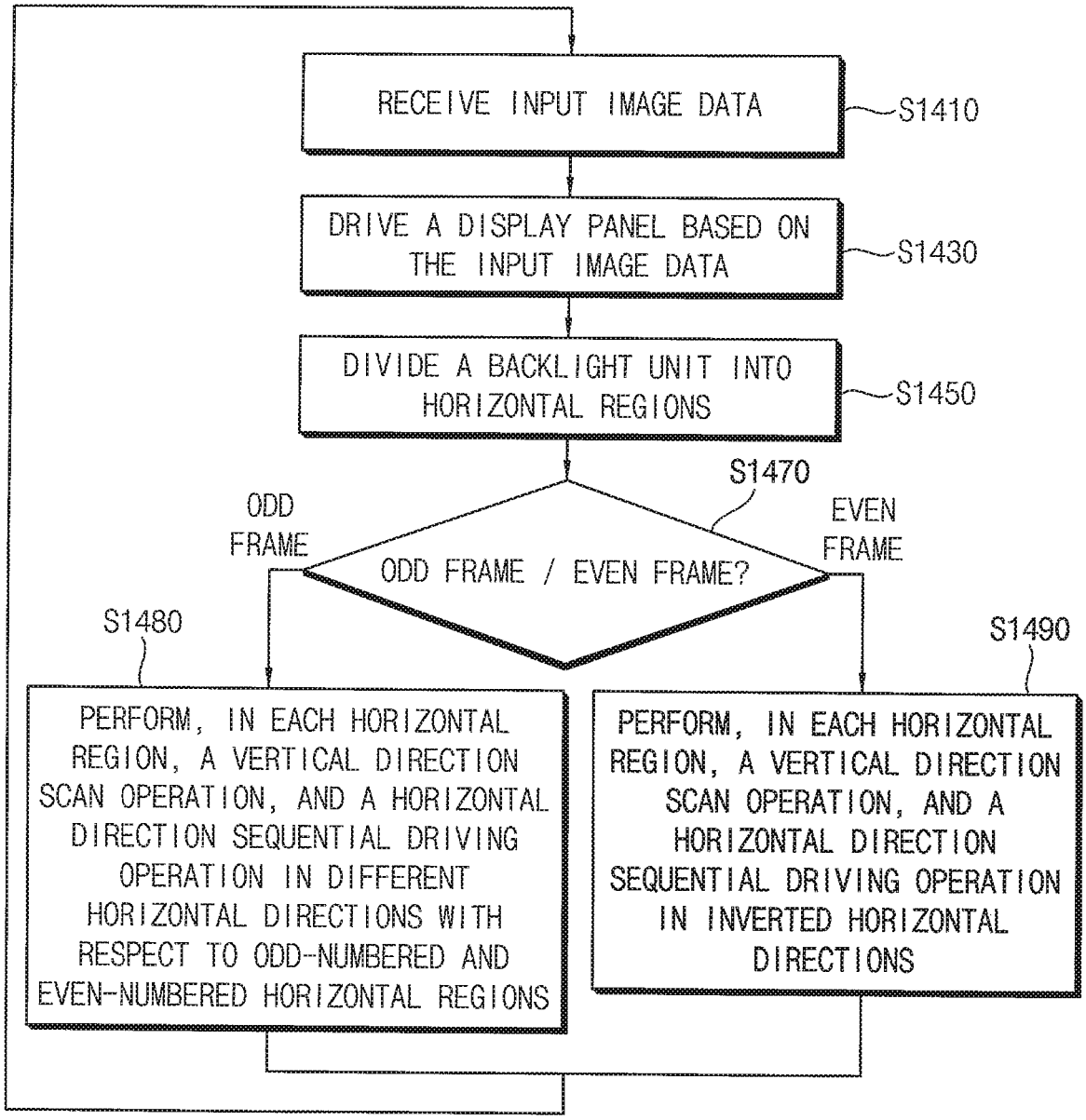
FIG. 22 is a flowchart of an operation of a display device according to an example embodiment.
Figure 23:
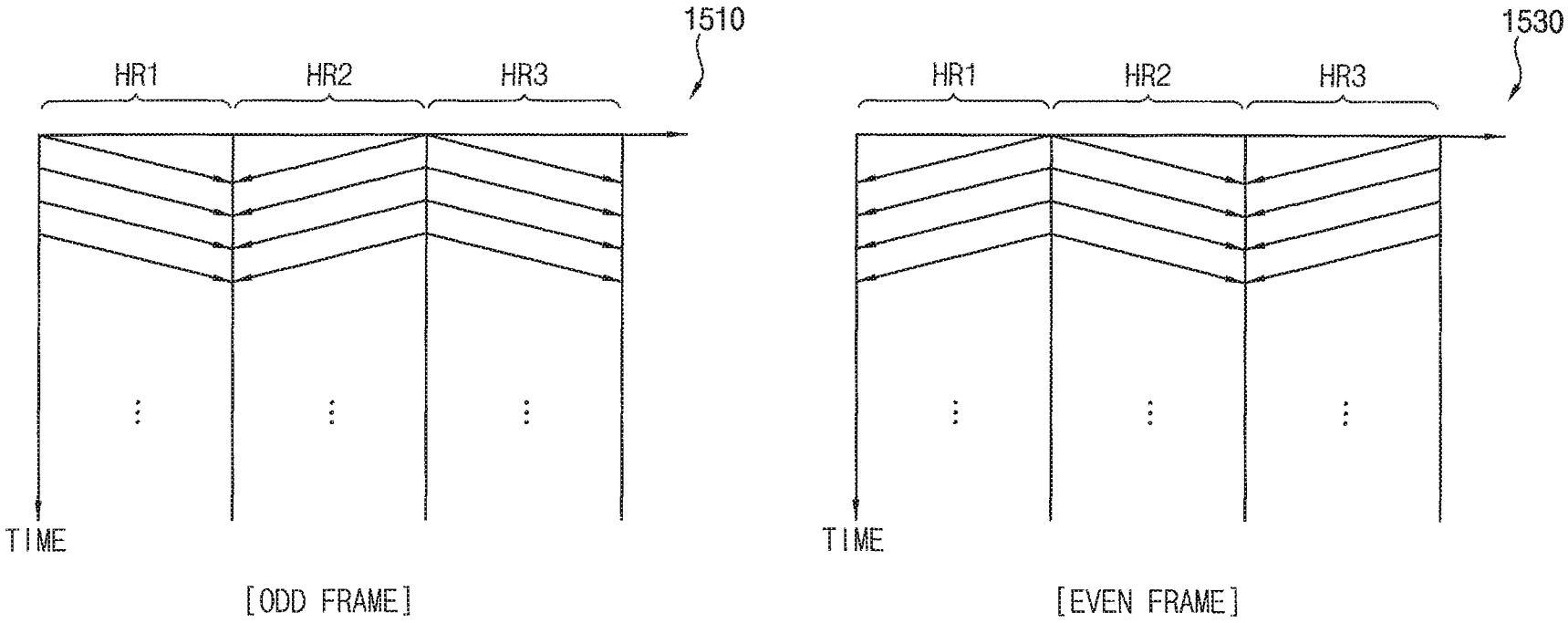
FIG. 23 is a diagram of an operation of a backlight unit of a display device performing an operation of FIG. 22 according to an example embodiment.

FIG. 22 is a flowchart of an operation of a display device according to an example embodiments. FIG. 23 is a diagram of an operation of a backlight unit of a display device performing an operation of FIG. 22 according to an example embodiment.

Referring to FIGS. 1 and 22, the panel driver 120 of the display device 100 may receive input image data IDAT in an operation S1410, and may drive the display panel 110 based on the input image data IDAT in an operation S1430.

The backlight driver 170 may divide the backlight unit 160 into horizontal regions in an operation S1450, may perform a vertical direction scan operation and a horizontal direction sequential driving operation in each horizontal region, and may further perform a frame inversion operation. Unlike the display device 100 performing an operation illustrated in FIG. 17, the display device 100 performing an operation illustrated in FIG. 22 may perform the horizontal direction sequential driving operation in different horizontal directions with respect to an odd-numbered horizontal region and an even-numbered horizontal region.

In some example embodiments, as illustrated as a graph 1510 in FIG. 23, to perform the horizontal direction sequential driving operation in an odd-numbered frame, the backlight driver 170 may sequentially drive light source blocks in a selected light source row within the odd-numbered horizontal region HR1 and HR3 in a first horizontal direction from a left light source block to a right light source block, and may sequentially drive the light source blocks in the selected light source row within the even-numbered horizontal region HR2 in a second horizontal direction from the right light source block to the left light source block in an operation S1470: ODD FRAME, and in an operation S1480. Further, as illustrated as a graph 1530 in FIG. 23, to perform the horizontal direction sequential driving operation in an even-numbered frame, the backlight driver 170 may sequentially drive the light source blocks in the selected light source row within the odd-numbered horizontal region HR1 and HR3 in the second horizontal direction, and may sequentially drive the light source blocks in the selected light source row within the even-numbered horizontal region HR2 in the first horizontal direction in the operation S1470: EVEN FRAME, and in an operation S1490.

Figure 24:
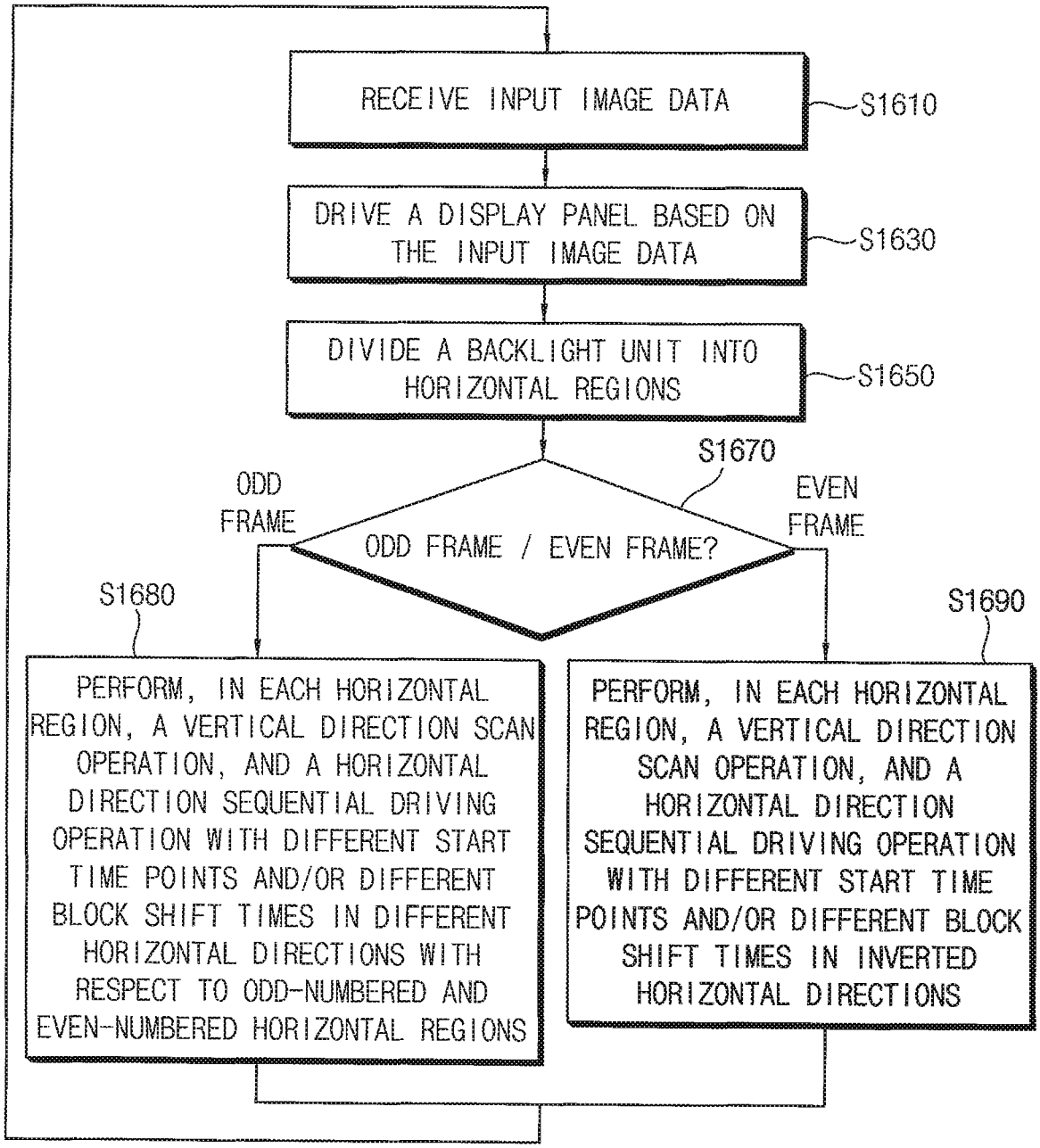
FIG. 24 is a flowchart of an operation of a display device according to an example embodiment.
Figure 25:
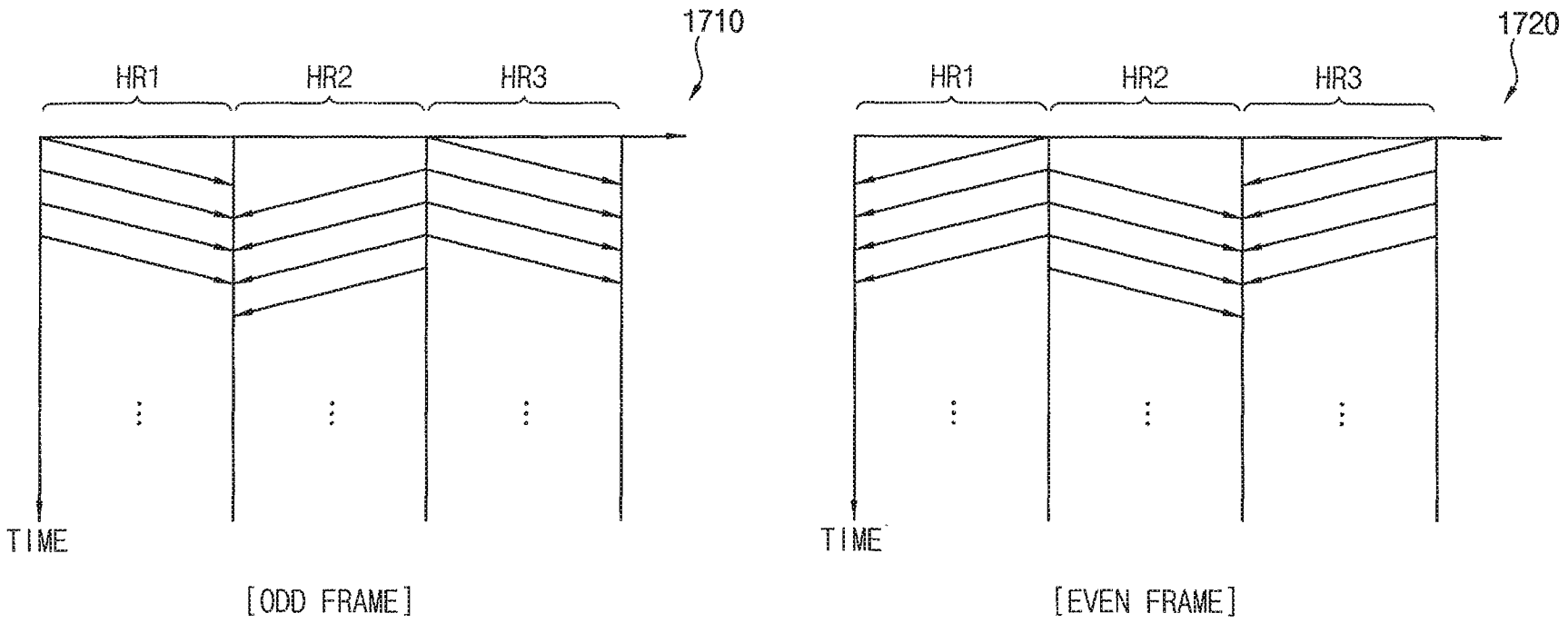
FIG. 25 is a diagram of an operation of a backlight unit of a display device performing an operation of FIG. 24 according to an example embodiment.
Figure 26:
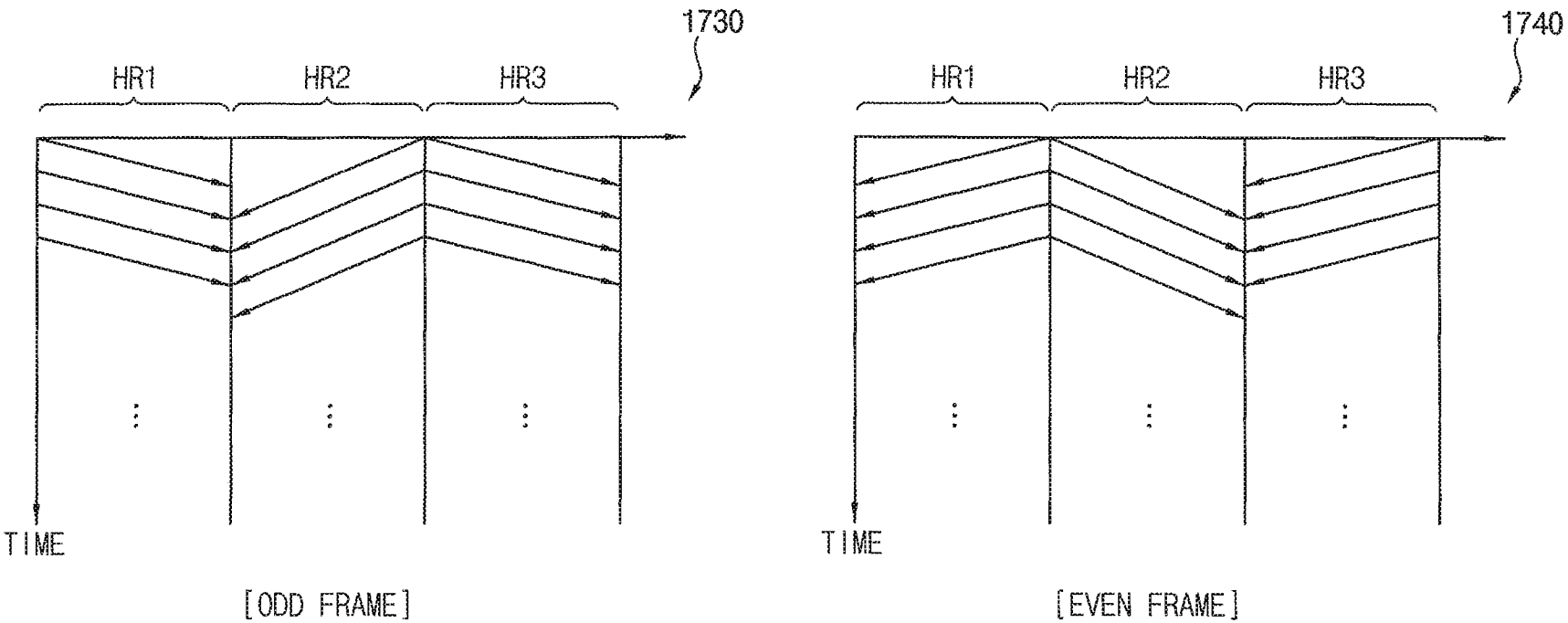
FIG. 26 is a diagram an operation of a backlight unit of a display device performing an operation of FIG. 24 according to an example embodiment.
Figure 27:
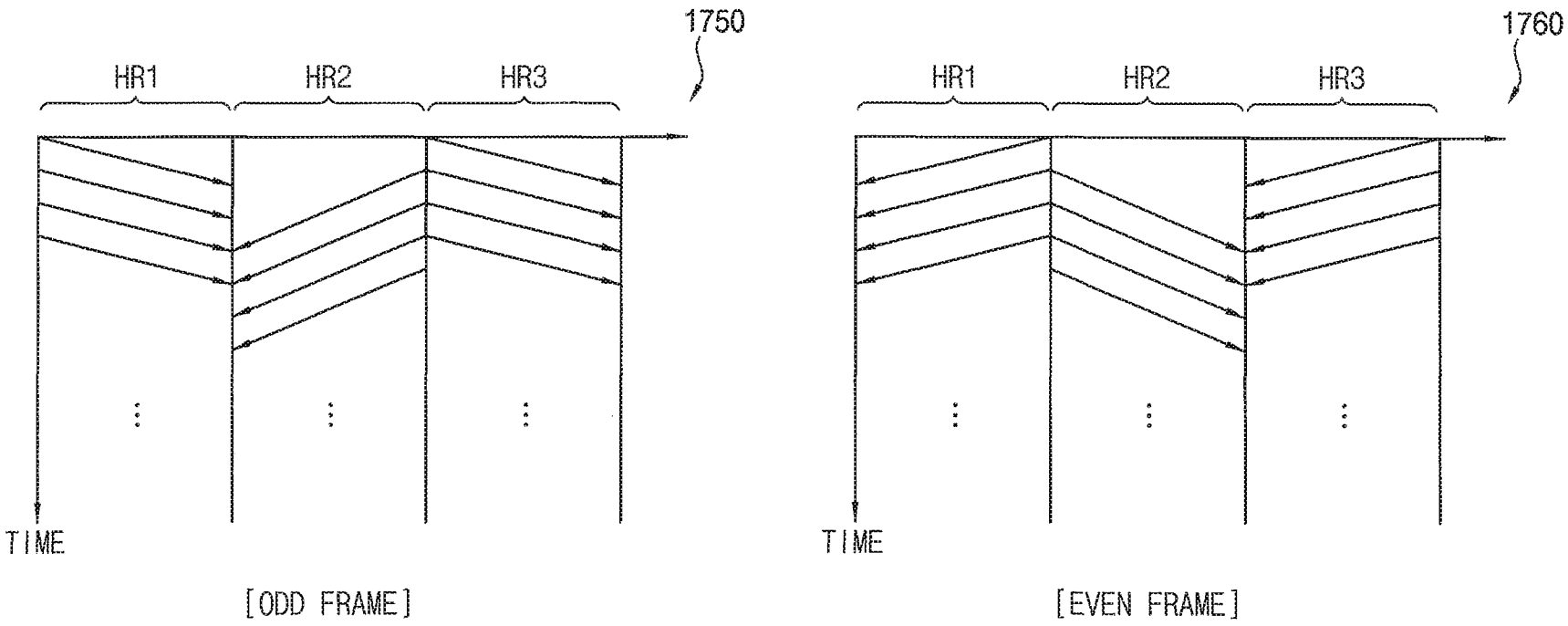
FIG. 27 is a diagram of an operation of a backlight unit of a display device performing an operation of FIG. 24 according to an example embodiment.

FIG. 24 is a flowchart of an operation of a display device according to an example embodiment. FIG. 25 is a diagram of an operation of a backlight unit of a display device performing an operation of FIG. 24 according to an example embodiment. FIG. 26 is a diagram of an operation of a backlight unit of a display device performing an operation of FIG. 24 according to an example embodiment. FIG. 27 is a diagram of an operation of a backlight unit of a display device performing an operation of FIG. 24 according to an example embodiment.

Referring to FIGS. 1 and 24, the panel driver 120 of the display device 100 may receive input image data IDAT in an operation S1610, and may drive the display panel 110 based on the input image data IDAT in an operation S1630.

The backlight driver 170 may divide the backlight unit 160 into horizontal regions in an operation S1650, may perform a vertical direction scan operation and a horizontal direction sequential driving operation in each horizontal region, and may further perform a frame inversion operation, and may further perform the horizontal direction sequential driving operation in different horizontal directions with respect to an odd-numbered horizontal region and an even-numbered horizontal region in operations S1670, S1680 and S1690. In the display device 100 performing an operation illustrated in FIG. 24, unlike the display device 100 performing an operation illustrated in FIG. 22, the horizontal direction sequential driving operation in the odd-numbered horizontal region and the horizontal direction sequential driving operation in the even-numbered horizontal region may have different start time points and/or different block shift times. In the display device 100 performing the operation illustrated in FIG. 22, light source blocks adjacent to boundaries of the horizontal regions may substantially simultaneously emit light. However, in the display device 100 performing the operation illustrated in FIG. 24, the light source blocks adjacent to the boundaries of the horizontal regions may emit light at different time points.

In an embodiment, as illustrated in FIG. 25, the horizontal direction sequential driving operation in the odd-numbered horizontal region HR1 and HR3 and the horizontal direction sequential driving operation in the even-numbered horizontal region HR2 may have different start time points. For example, as illustrated as graphs 1710 and 1720 in FIG. 25, the start time point of the horizontal direction sequential driving operation in the even-numbered horizontal region HR2 may be delayed compared with the start time point of the horizontal direction sequential driving operation in the odd-numbered horizontal region HR1 and HR3. For example, the vertical direction scan operation and the horizontal direction sequential driving operation in the odd-numbered horizontal region HR1 and HR3 may be initiated at a time point at which a vertical start signal STV is generated, and the vertical direction scan operation and the horizontal direction sequential driving operation in the even-numbered horizontal region HR2 may be initiated after a predetermined time from the time point at which the vertical start signal STV is generated.

In other example embodiments, as illustrated in FIG. 26, the horizontal direction sequential driving operation in the odd-numbered horizontal region HR1 and HR3 and the horizontal direction sequential driving operation in the even-numbered horizontal region HR2 may have different block shift times. For example, as illustrated as graphs 1730 and 1740 in FIG. 26, the block shift time of the horizontal direction sequential driving operation in the even-numbered horizontal region HR2 may be longer than the block shift time of the horizontal direction sequential driving operation in the odd-numbered horizontal region HR1 and HR3. Thus, a duration of the horizontal direction sequential driving operation for each light source row in the even-numbered horizontal region HR2 may be longer than a duration of the horizontal direction sequential driving operation for each light source row in the odd-numbered horizontal region HR1 and HR3, and a line representing the horizontal direction sequential driving operation for each light source row in the even-numbered horizontal region HR2 may have a relatively steep slope in the graphs 1730 and 1740.

In an embodiment, as illustrated in FIG. 27, the horizontal direction sequential driving operation in the odd-numbered horizontal region HR1 and HR3 and the horizontal direction sequential driving operation in the even-numbered horizontal region HR2 may have the different start time points and the different block shift times. For example, as illustrated as graphs 1750 and 1760 in FIG. 27, the start time point of the horizontal direction sequential driving operation in the even-numbered horizontal region HR2 may be delayed compared with the start time point of the horizontal direction sequential driving operation in the odd-numbered horizontal region HR1 and HR3, and the block shift time of the horizontal direction sequential driving operation in the even-numbered horizontal region HR2 may be longer than the block shift time of the horizontal direction sequential driving operation in the odd-numbered horizontal region HR1 and HR3. Accordingly, the light source blocks adjacent to the boundaries of the horizontal regions HR1, HR2 and HR3 may emit light at different time points.

Figure 28:
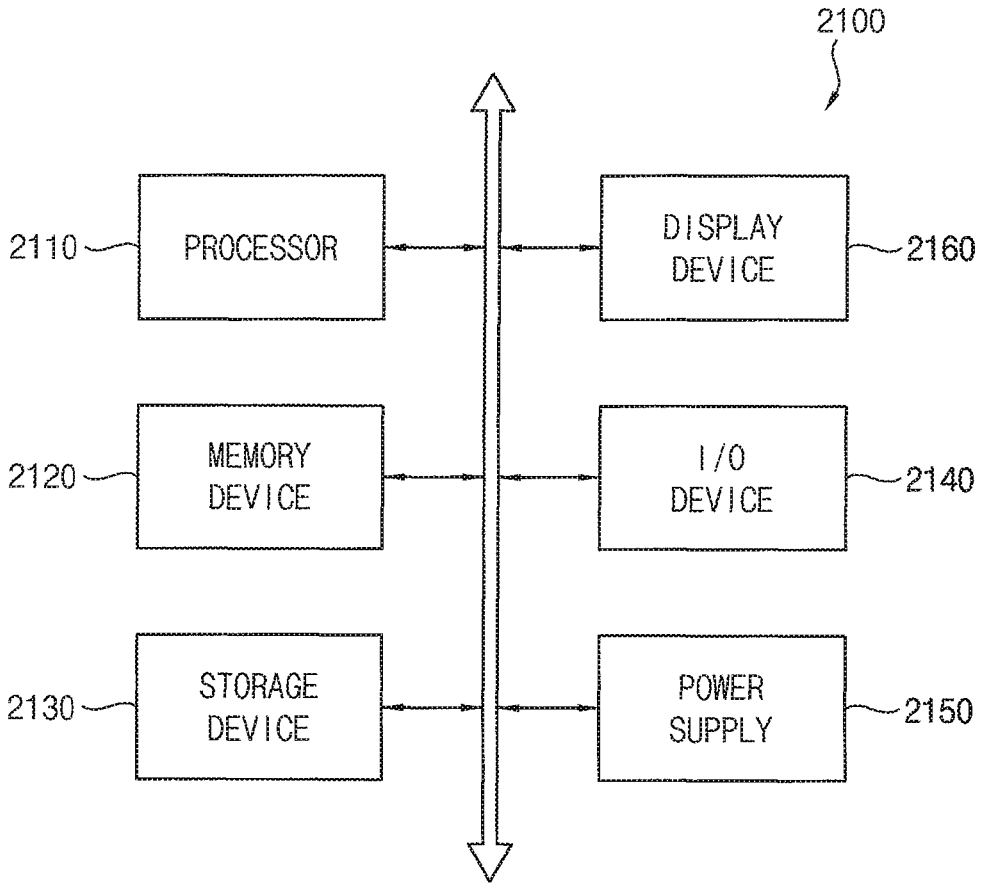
FIG. 28 is a block diagram of an electronic device including a display device according to an example embodiment.

FIG. 28 is a block diagram of an electronic device 2100 including a display device 2160 according to an example embodiments Referring to FIG. 28, the electronic device 2100 may include a processor 2110, a memory device 2120, a storage device 2130, an input/output (I/O) device 2140, a power supply 2150, and the display device 2160. The electronic device 2100 may further include ports for communicating with a video card, a sound card, a memory card, a universal serial bus (USB) device, or other electric devices.

The processor 2110 may perform various computing functions or tasks. The processor 2110 may be an application processor (AP), a micro processor, a central processing unit (CPU), etc. The processor 2110 may be coupled to other components via an address bus, a control bus, a data bus, etc. Further, in some example embodiments, the processor 2110 may be further coupled to an extended bus such as a peripheral component interconnection (PCI) bus.

The memory device 2120 may store data for operations of the electronic device 2100. For example, the memory device 2120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 2130 may be a solid-state drive (SSD) device, a hard disk drive (HDD) device, a CD-ROM device, etc. The I/O device 2140 may include an input device such as a keyboard, a keypad, a mouse, a touch screen, etc, and/or an output device such as a printer, a speaker, etc. The power supply 2150 may supply power for operations of the electronic device 2100. The display device 2160 may be coupled to other components through the buses or other communication links.

The display device 2160 may perform a vertical direction scan operation that sequentially selects light source rows included in a backlight unit, and a horizontal direction sequential driving operation that sequentially drives light source blocks included in a selected light source row. Accordingly, a waterfall phenomenon where a relatively high or low luminance horizontal line image exists or gradually moves may be prevented or reduced while local dimming is performed.

The inventive concepts may be applied to any display device 2160, and any electronic device 2100 including the display device 2160. For example, the inventive concepts may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display device comprising:

a backlight unit including light source rows, each of the light source rows including light source blocks;

a display panel configured to display an image by transmitting light emitted by the backlight unit;

a panel driver configured to drive the display panel; and a backlight driver configured to drive the backlight unit, wherein the backlight driver is configured to perform a vertical direction scan operation that sequentially selects the light source rows and a horizontal direction sequential driving operation that sequentially drives the light source blocks included in a selected light source row of the light source rows, wherein the light source rows include a first light source row and a second light source row, and wherein the backlight driver is configured to initiate the horizontal direction sequential driving operation for the second light source row before the horizontal direction sequential driving operation for the first light source row is completed.

2. The display device of claim 1, wherein, to perform the vertical direction scan operation, the backlight driver is configured to sequentially select a light source row of the light source rows based on a first time period.

3. The display device of claim 2, wherein the first time period is determined by dividing a frame time by a number of the light source rows.

4. The display device of claim 1, wherein to perform the horizontal direction sequential driving operation, the backlight driver is configured to sequentially drive a light source block of the light source blocks included in the selected light source row of the light source rows based on a second time period.

5. The display device of claim 4, wherein the second time period is determined by dividing a latency time from a data input time point to an image display time point by a number of the light source blocks included in each of the light source rows.

6. A display device comprising:

a backlight unit including light source rows, each of the light source rows including light source blocks;

a display panel configured to display an image by transmitting light emitted by the backlight unit;

a panel driver configured to drive the display panel; and a backlight driver configured to drive the backlight unit, wherein the backlight driver is configured to perform a vertical direction scan operation that sequentially selects the light source rows and a horizontal direction sequential driving operation that sequentially drives the light source blocks included in a selected light source row of the light source rows, wherein each of the light source rows includes first through M-th light source blocks, where M is an integer greater than 1, and wherein, to perform the horizontal direction sequential driving operation, the backlight driver is configured to sequentially drive the first through M-th light source blocks included in the selected light source row of the light source rows in a first horizontal direction from the first light source block to the M-th light source block in an odd-numbered frame, and sequentially drive the first through M-th light source blocks included in the selected light source row of the light source rows in a second horizontal direction from the M-th light source block to the first light source block in an even-numbered frame.

7. A display device comprising:

a backlight unit including light source rows, each of the light source rows including light source blocks;

a display panel configured to display an image by transmitting light emitted by the backlight unit;

a panel driver configured to drive the display panel; and a backlight driver configured to drive the backlight unit, wherein the backlight driver is configured to divide the backlight unit into horizontal regions, and perform, in each of the horizontal regions, a vertical direction scan operation that sequentially selects the light source rows and a horizontal direction sequential driving operation that sequentially drives the light source blocks included in a selected light source row of the light source rows, and wherein to perform the horizontal direction sequential driving operation in each of the horizontal regions, the backlight driver is configured to sequentially drive the light source blocks in the selected light source row of the light source rows in each of the horizontal regions in a first horizontal direction in an odd-numbered frame, and sequentially drive the light source blocks in the selected light source row of the light source rows in each of the horizontal regions in a second horizontal direction opposite to the first horizontal direction in an even-numbered frame.

8. The display device of claim 7, wherein, to perform the horizontal direction sequential driving operation in each of the horizontal regions, the backlight driver is configured to sequentially drive a light source block of the light source blocks included in the selected light source row of the light source rows in each of the horizontal regions per a block shift time.

9. The display device of claim 8, wherein the block shift time is determined by dividing a latency time from a data input time point to an image display time point by a number of the light source blocks included in each of the light source rows in each of the horizontal regions.

* * * * *